US008884854B2

(12) United States Patent
Taneda et al.

(10) Patent No.: US 8,884,854 B2
(45) Date of Patent: Nov. 11, 2014

(54) DISPLAY, METHOD FOR DRIVING DISPLAY, AND ELECTRONIC APPARATUS

(75) Inventors: Takayuki Taneda, Kanagawa (JP); Tetsuro Yamamoto, Kanagawa (JP); Katsuhide Uchino, Kanagawa (JP)

(73) Assignee: Sony Corporation, Tokyo (JP)

( * ) Notice: Subject to any disclaimer, the term of this patent is extended or adjusted under 35 U.S.C. 154(b) by 1376 days.

(21) Appl. No.: 12/078,240

(22) Filed: Mar. 28, 2008

(65) Prior Publication Data

US 2008/0246747 A1 Oct. 9, 2008

(30) Foreign Application Priority Data

Apr. 9, 2007 (JP) ..... 2007-101281

(51) Int. Cl.
*G09G 3/32* (2006.01)

(52) U.S. Cl.
CPC ..... *G09G 3/3233* (2013.01); *G09G 2320/0233* (2013.01); *G09G 2300/0866* (2013.01); *G09G 2320/043* (2013.01); *G09G 2300/0819* (2013.01); *G09G 2310/0256* (2013.01); *G09G 2310/0297* (2013.01); *G09G 3/3291* (2013.01); *G09G 2300/0842* (2013.01)
USPC ..... 345/82; 345/76

(58) Field of Classification Search
None
See application file for complete search history.

(56) References Cited

U.S. PATENT DOCUMENTS

| | | | | |
|---|---|---|---|---|
| 7,868,859 | B2 * | 1/2011 | Tomida et al. | 345/82 |
| 7,898,509 | B2 * | 3/2011 | Iida et al. | 345/76 |
| 8,089,430 | B2 * | 1/2012 | Ilda et al. | 345/76 |
| 8,174,466 | B2 * | 5/2012 | Toyomura et al. | 345/76 |
| 8,237,632 | B2 * | 8/2012 | Yamashita et al. | 345/76 |
| 8,269,755 | B2 * | 9/2012 | Minami | 345/208 |
| 8,384,626 | B2 * | 2/2013 | Yamamoto et al. | 345/76 |
| 8,432,389 | B2 * | 4/2013 | Yamamoto et al. | 345/212 |
| 8,471,840 | B2 * | 6/2013 | Iida et al. | 345/212 |
| 8,477,087 | B2 * | 7/2013 | Yamamoto et al. | 345/76 |
| 8,593,445 | B2 * | 11/2013 | Yamamoto et al. | 345/211 |
| 8,692,746 | B2 * | 4/2014 | Ebisuno | 345/77 |
| 2003/0095087 | A1 * | 5/2003 | Libsch et al. | 345/82 |
| 2006/0170628 | A1 * | 8/2006 | Yamashita et al. | 345/76 |
| 2006/0176250 | A1 * | 8/2006 | Nathan et al. | 345/76 |
| 2006/0267884 | A1 * | 11/2006 | Takahashi et al. | 345/76 |
| 2008/0158110 | A1 * | 7/2008 | Iida et al. | 345/76 |
| 2009/0244050 | A1 * | 10/2009 | Yamamoto et al. | 345/212 |
| 2009/0278771 | A1 * | 11/2009 | Yamamoto et al. | 345/76 |
| 2009/0315812 | A1 * | 12/2009 | Yamamoto et al. | 345/76 |
| 2010/0149152 | A1 * | 6/2010 | Yamamoto et al. | 345/211 |
| 2010/0149166 | A1 * | 6/2010 | Iida et al. | 345/212 |

FOREIGN PATENT DOCUMENTS

JP 2006-133542 5/2006

* cited by examiner

*Primary Examiner* — Seokyun Moon

(74) *Attorney, Agent, or Firm* — Rader, Fishman & Grauer PLLC

(57) ABSTRACT

Disclosed herein is a display including: a pixel array part configured to include pixels arranged in a matrix, each of the pixels including an electro-optical element, a write transistor for sampling and writing an input signal voltage supplied through a signal line, a holding capacitor for holding the input signal voltage written by the write transistor, and a drive transistor for driving the electro-optical element based on the input signal voltage held in the holding capacitor.

9 Claims, 16 Drawing Sheets

DISPLAY, METHOD FOR DRIVING DISPLAY, AND ELECTRONIC APPARATUS

CROSS REFERENCES TO RELATED APPLICATIONS

The present invention contains subject matter related to Japanese Patent Application JP 2007-101281 filed in the Japan Patent Office on Apr. 9, 2007, the entire contents of which are incorporated herein by reference.

BACKGROUND OF THE INVENTION

1. Field of the Invention

The present invention relates to a display, a method for driving a display, and an electronic apparatus, particularly to a flat-type (flat-panel) display in which pixels, each including an electro-optical element, are arranged on rows and columns (in a matrix), a method for driving the display, and an electronic apparatus including the display.

2. Description of the Related Art

In recent years, in the field of displays for image displaying, an organic electroluminescence (EL) display is being developed and commercialized as one of the flat-type displays obtained by arranging pixels (pixel circuits), each including a light-emitting element, in a matrix. The organic EL display includes organic EL elements as the light-emitting elements of the respective pixels. The organic EL element is a so-called current-driven electro-optical element whose light-emission luminance varies depending on the value of the current flowing through the element, and it is based on a phenomenon that light emission occurs in response to an electric field application to an organic thin film.

The organic EL display has the following features. Specifically, the organic EL display has a low power consumption because the organic EL element can be driven by an application voltage lower than 10 V. Furthermore, because the organic EL element is a self-luminous element, the organic EL display provides a higher image visibility compared with a liquid crystal display, which displays an image by controlling, for each pixel including a liquid crystal cell, the intensity of light from a light source (backlight) by the liquid crystal cell. In addition, the organic EL display does not need to have an illuminating unit such as a backlight, which is necessary for the liquid crystal display, and therefore a reduction in the weight and thickness of the organic EL display can be achieved easily. Moreover, the response speed of the organic EL element is as very high as several microseconds, which causes no image lag in displaying a moving image by the organic EL display.

As the drive system for the organic EL display, a simple-(passive-) matrix system or an active-matrix system can be employed, similarly to the liquid crystal display. However, a display of the simple-matrix system involves the problem that it is difficult to realize a large-size and high-definition display although the configuration thereof is simple. For this reason, in recent years, a display of the active-matrix system is being actively developed in which the current flowing through an electro-optical element is controlled by an active element, such as an insulated gate field effect transistor (typically, a thin film transistor (TFT)), provided in the same pixel circuit as that including this electro-optical element.

It is generally known that the I-V characteristic (current-voltage characteristic) of an organic EL element deteriorates as the time elapses (so-called age deterioration). In a pixel circuit including a N-channel TFT as a transistor for driving an organic EL element by current (hereinafter, referred to as a "drive transistor"), the organic EL element is connected to the source side of the drive transistor. Therefore, the age deterioration of the I-V characteristic of the organic EL element leads to a change in the gate-source voltage Vgs of the drive transistor, which results in a change in the light-emission luminance of the organic EL element.

A more specific description about this point will be given below. The source potential of the drive transistor is determined depending on the operating point of the drive transistor and the organic EL element. The deterioration of the I-V characteristic of the organic EL element varies the operating point of the drive transistor and the organic EL element. Therefore, even when the same voltage is applied to the gate of the drive transistor, the source potential of the drive transistor varies. This varies the source-gate voltage Vgs of the drive transistor, which changes the value of the current flowing through the drive transistor. As a result, the value of the current flowing through the organic EL element also changes, which varies the light-emission luminance of the organic EL element.

Furthermore, a pixel circuit employing a poly-silicon TFT involves, in addition to the age deterioration of the I-V characteristic of the organic EL element, changes over time in the threshold voltage Vth of the drive transistor and the mobility μ in the semiconductor thin film serving as the channel of the drive transistor (hereinafter, referred to as "the mobility of the drive transistor"), and a difference in the threshold voltage Vth and the mobility μ from pixel to pixel due to variation in the manufacturing process (variation in transistor characteristics among the respective drive transistors).

If the threshold voltage Vth and mobility μ of the drive transistor are different from pixel to pixel, a variation in the value of the current flowing through the drive transistor arises on a pixel-by-pixel basis. Therefore, even when the same voltage is applied to the gate of the drive transistor, the variation in the light-emission luminance of the organic EL element among the pixels arises, which results in a lowered uniformity of the screen.

To address this problem, there has been proposed a configuration aiming to allow the light-emission luminance of the organic EL element to be kept constant without being affected by the age deterioration of the I-V characteristic of the organic EL element and changes over time in the threshold voltage Vth and mobility μ of the drive transistor. Specifically, in this configuration, each of the pixel circuits is provided with a compensation function against change in the characteristic of the organic EL element, and correction functions for correction against variation in the threshold voltage Vth of the drive transistor (hereinafter, referred to as "threshold correction") and correction against variation in the mobility μ of the drive transistor (hereinafter, referred to as "mobility correction") (refer to e.g. Japanese Patent Laid-Open No. 2006-133542 (hereinafter referred to as Patent Document 1)).

By thus providing each pixel circuit with the compensation function against change in the characteristic of the organic EL element and the correction functions against variation in the threshold voltage Vth and mobility μ of the drive transistor, the light-emission luminance of the organic EL element can be kept constant without being affected by the age deterioration of the I-V characteristic of the organic EL element and changes over time in the threshold voltage Vth and mobility μ of the drive transistor.

In an organic EL display employing the configuration in which each pixel circuit is provided with the correction functions for threshold correction and mobility correction as described above, the following four kinds of operation are cyclically carried out for each pixel row: threshold correction preparation in which the gate potential Vg and source potential Vs of the drive transistor are fixed at the respective predetermined potentials; threshold correction in which the source potential Vs of the drive transistor is sufficiently raised to fix the gate-source voltage Vgs of the drive transistor at the threshold voltage Vth thereof; signal writing in which the signal voltage Vsig of a video signal dependent upon luminance information is written in the pixel; and mobility correction in which correction relating to the mobility μ is carried out (details of the respective operations will be described later.

In the case of carrying out these four operations in the period of 1 H (H denotes the horizontal scanning period/horizontal synchronizing cycle) for each pixel row, there is a problem that it is difficult to ensure, as the threshold correction period and the mobility correction period, sufficiently-long times to carry out the respective correction operations surely. In particular, the number of pixels tends to be increasing year by year in linkage with the enhancement in the display definition, and the period of 1 H is becoming shorter along with the increase in the number of pixels. Therefore, currently, it is becoming difficult to ensure sufficiently-long times as the threshold correction period and the mobility correction period.

Not only in the organic EL display provided with both the correction functions for threshold correction and mobility correction but also in an organic EL display provided with only the threshold correction function, the time that can be ensured as the threshold correction period becomes shorter due to the shortening of the period of 1 H.

If sufficient time may not be ensured as the correction period for threshold correction or the respective correction periods for threshold correction and mobility correction, the threshold correction operation or the respective correction operations of threshold correction and mobility correction may not be surely carried out. This results in a failure in sufficient suppression of the variation in the current flowing through the drive transistor from pixel to pixel. Therefore, as described above, even when the same voltage is applied to the gate of the drive transistor, the variation in the light-emission luminance of the organic EL element among the pixels arises, which lowers the uniformity of the screen.

SUMMARY OF THE INVENTION

There is a need for the present invention to provide a display that is allowed to ensure, at least as the correction period for threshold correction, a sufficiently-long time to carry out the correction operation surely, a method for driving the display, and an electronic apparatus including the display.

According to a mode of the present invention, there is provided a display including a pixel array part configured to include pixels arranged in a matrix. Each of the pixels includes an electro-optical element, a write transistor for sampling and writing an input signal voltage supplied through a signal line, a holding capacitor for holding the input signal voltage written by the write transistor, and a drive transistor for driving the electro-optical element based on the input signal voltage held in the holding capacitor. The display further includes a drive circuit configured to selectively scan the pixels in the pixel array part on a row-by-row basis and carry out an operation of threshold correction against variation in the threshold voltage of the drive transistor for each selected row with a cycle of one horizontal scanning period. The drive circuit carries out a preparation operation of fixing the gate potential and source potential of the drive transistor at the respective predetermined potentials before the operation of threshold correction for a correction-target pixel row, over a plurality of horizontal scanning periods previous to the start of one horizontal scanning period of the correction-target pixel row and in periods during which the input signal voltage is not supplied to the signal line.

In the display having this configuration and the electronic apparatus including the display, the operation of threshold correction preparation of fixing the gate potential and source potential of the drive transistor at the respective predetermined potentials is carried out before the start of one horizontal scanning period of the correction-target pixel row. This feature eliminates the need to ensure the period for the threshold correction preparation in the one horizontal scanning period of the correction-target pixel row and thus can correspondingly extend the correction period for the threshold correction.

Furthermore, the operation of threshold correction preparation is carried out intermittently in the periods during which the input signal voltage is not supplied to the signal line over a plurality of horizontal scanning periods previous to the start of the one horizontal scanning period of the correction-target pixel row. Thus, when the input signal voltage is being written on the correction-target pixel row, all the other pixel rows are in the non-writing state. Therefore, the capacitances of the holding capacitors in the respective pixels on other pixel rows are rarely added to the signal line. This allows the operation of the threshold correction preparation to be carried out surely with a sufficiently-long threshold correction preparation period ensured, while preventing an increase in the capacitance of the signal line.

The mode of the present invention can ensure, as the period for the threshold correction, a sufficiently-long time to carry out the operation of the threshold correction surely. Furthermore, the mode of the present invention allows the operation of the threshold correction preparation to be carried out surely with a sufficiently-long threshold correction preparation period ensured, while preventing an increase in the capacitance of the signal line. This can suppress the age deterioration of the electro-optical element and the variation in characteristics of the drive transistor sufficiently, and thus can provide a display having a favorable image quality.

BRIEF DESCRIPTION OF THE DRAWINGS

FIGS. 19A and 19B are a front view and side view, respectively, of the opened state; and FIGS. 19C to 19G are a front view, left-side view, right-side view, top view, and bottom view, respectively, of the closed state.

DETAILED DESCRIPTION OF THE PREFERRED EMBODIMENT

An embodiment of the present invention will be described in detail below with reference to the accompanying drawings.

Figure 1:
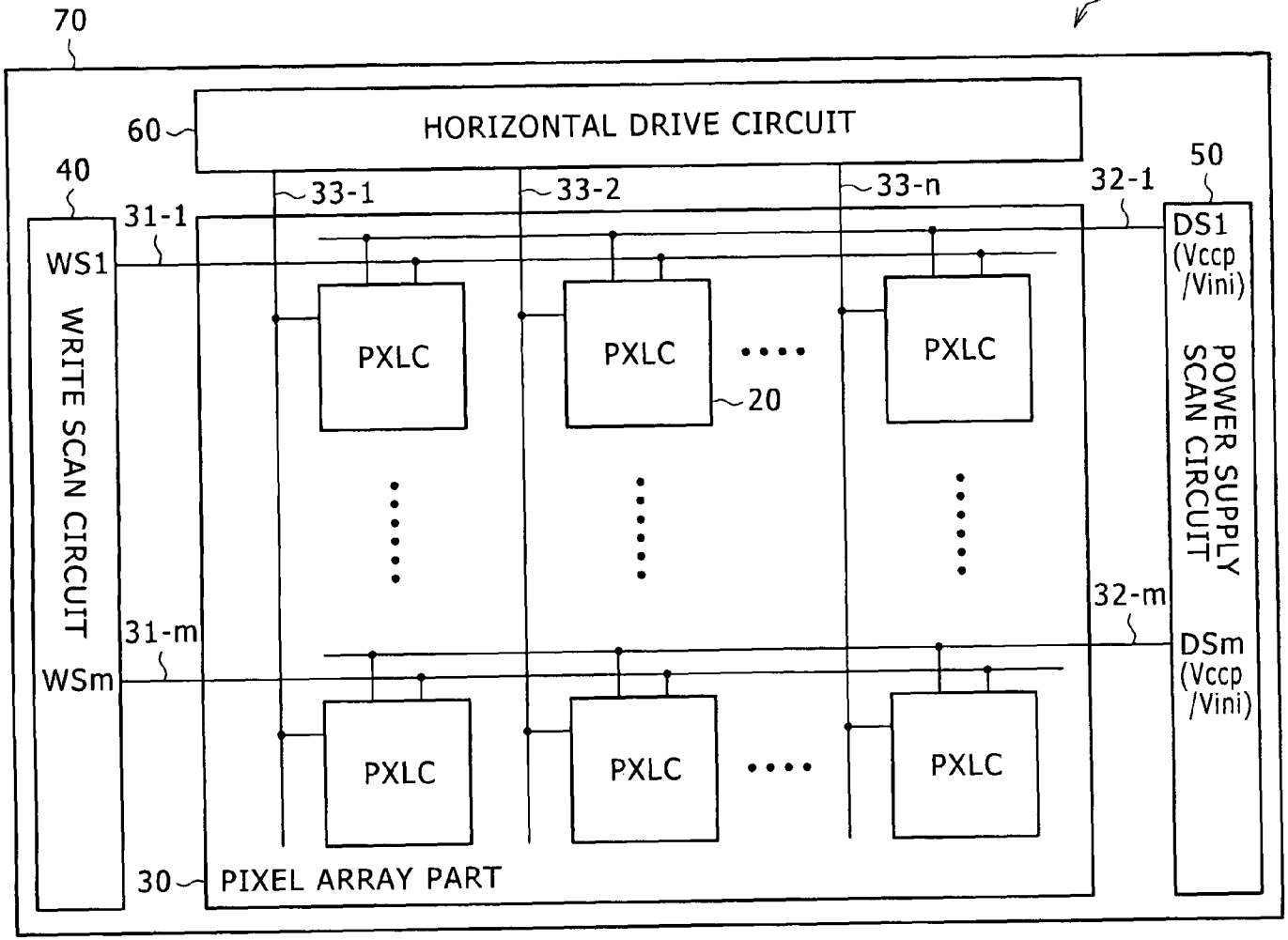
FIG. 1 is a system configuration diagram showing the schematic configuration of an organic EL display according to one embodiment of the present invention.

FIG. 1 is a system configuration diagram showing the schematic configuration of an active-matrix display according to one embodiment of the present invention. As one example, the following description will deal with an active-matrix organic EL display that employs, as a light-emitting element of each pixel, an organic EL element, which is a current-driven electro-optical element whose light-emission luminance varies depending on the current flowing through the element.

As shown in FIG. 1, an organic EL display 10 according to the present embodiment includes a pixel array part 30 in which pixels (PXLC) 20 are two-dimensionally arranged on rows and columns (in a matrix). Furthermore, the organic EL display 10 includes a write scan circuit 40, a power supply scan circuit 50, and a horizontal drive circuit 60 as drivers that are disposed in the periphery of the pixel array part 30 and drive the respective pixels 20.

In the pixel array part 30, corresponding to the pixel arrangement of m rows and n columns, scan lines 31-1 to **31-*m* and power supply lines 32-1 to 32-*m* are provided for the respective pixel rows, and signal lines 33-1 to 33-*n*** are provided for the respective pixel columns.

The pixel array part 30 is formed typically on a transparent insulating substrate, such as a glass substrate, and has a flat-type panel structure. Each of the pixels 20 in the pixel array part 30 can be formed by using an amorphous, silicon thin film transistor (TFT) or a low-temperature poly-silicon TFT. In the case of using the low-temperature poly-silicon TFT, the scan circuit 40, the power supply scan circuit 50, and the horizontal drive circuit 60 also can be mounted on a display panel (substrate) 70 on which the pixel array part 30 is formed.

The write scan circuit 40 includes a shift register for sequentially shifting (transferring) a start pulse sp in synchronization with a clock pulse ck. For writing of the video signal to the pixels 20 in the pixel array part 30, the write scan circuit 40 sequentially supplies scan signals WS1 to WSm to the scan lines 31-1 to **31-*m*, for sequential scanning of the pixels 20** on a row-by-row basis (line-sequential scanning).

The power supply scan circuit 50 includes a shift register for sequentially shifting the start pulse sp in synchronization with the clock pulse ck. In synchronization with the line-sequential scanning by the write scan circuit 40, the power supply scan circuit 50 supplies the power supply lines 32-1 to **32-*m* with power supply line potentials DS1** to DSm that are each switched between a first potential Vccp and a second potential Vini lower than the first potential Vccp.

The horizontal drive circuit 60 properly selects either one of a signal voltage Vsig or an offset voltage Vofs of the video signal, which is supplied from a signal supply source (not shown) and which corresponds to luminance information, and writes the video signal to the pixels 20 in the pixel array part 30 via the signal lines 33-1 to **33-*n* simultaneously, e.g., in units of rows. That is, the horizontal drive circuit 60** employs a drive form for line-sequential writing in which the input signal voltage Vsig is written simultaneously in units of rows (lines).

The offset voltage Vofs is the voltage serving as the reference (equivalent to, e.g., the black level) of the signal voltage (hereinafter, it will be referred to as "input signal voltage" or simply as "signal voltage") Vsig of the video signal. The second potential Vini is sufficiently lower than the offset voltage Vofs.

(Pixel Circuit)

Figure 2:
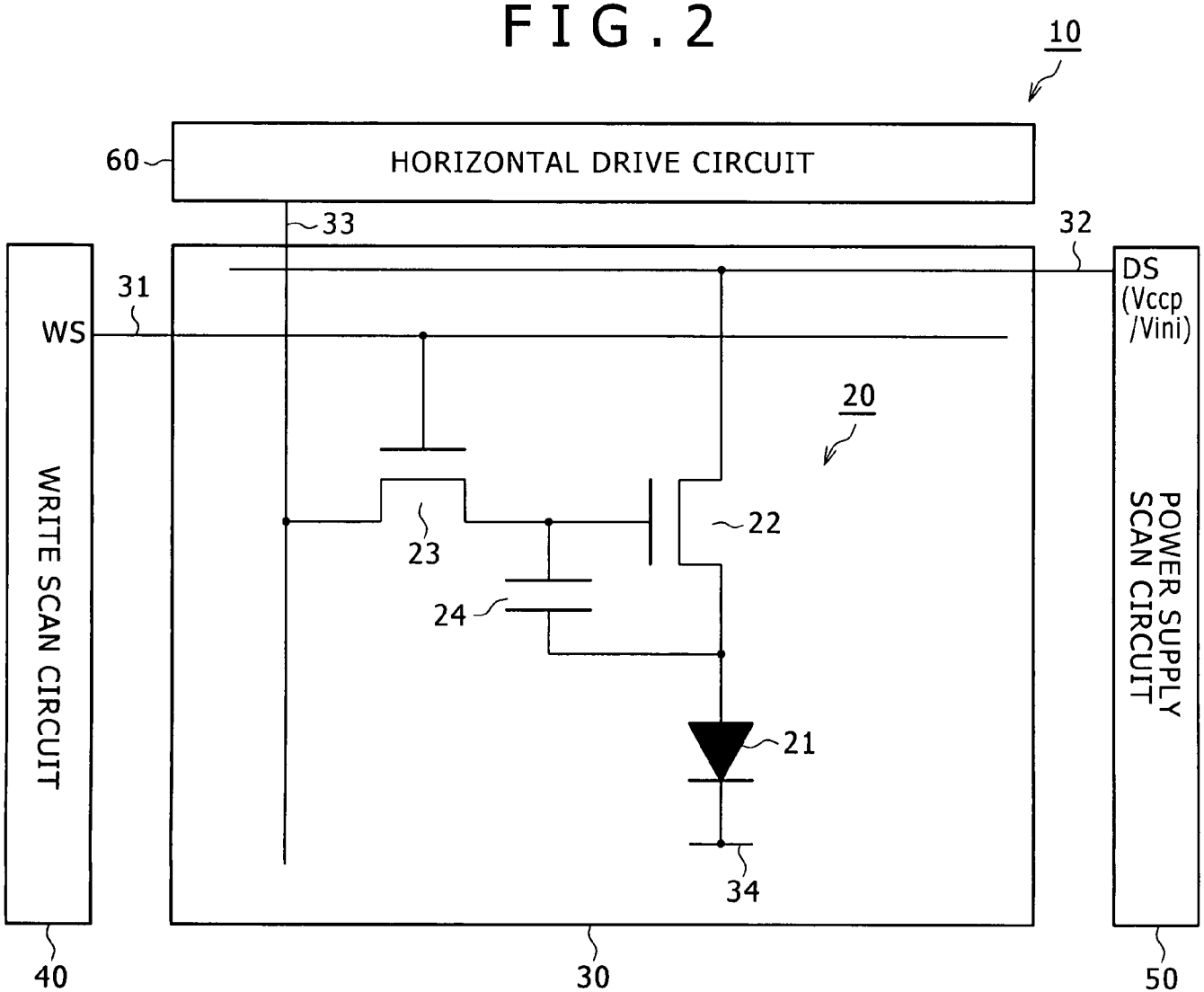
FIG. 2 is a circuit diagram showing a specific configuration example of a pixel (pixel circuit)

FIG. 2 is a circuit diagram showing a specific configuration example of the pixel (pixel circuit) 20. As shown in FIG. 2, the pixel 20 includes, as a light-emitting element, an organic EL element 21, which is a current-driven electro-optical element whose light-emission luminance varies depending on the current flowing through the element. In addition to the organic EL element 21, the pixel 20 includes a drive transistor 22, a write transistor 23, and a holding capacitor 24.

As the drive transistor 22 and the write transistor 23, N-channel TFTs are used. This combination of the conductivity types of the drive transistor 22 and the write transistor 23 is merely one example, and the combination is not limited thereto.

The cathode electrode of the organic EL element 21 is connected to a common power supply line 34 that is provided in common to all the pixels 20. The source electrode of the drive transistor 22 is connected to the anode electrode of the organic EL element 21, and the drain electrode of the drive transistor 22 is connected to the power supply line 32 (32-1 to **32-*m***).

The gate electrode of the write transistor 23 is connected to the scan line 31 (31-1 to **31-*m*). One electrode (source electrode/drain electrode) of the write transistor 23 is connected to the signal line 33 (33-1 to 33-*n*), and the other electrode (drain electrode/source electrode) thereof is connected to the gate electrode of the drive transistor 22. One end of the holding capacitor 24 is connected to the gate electrode of the drive transistor 22, and the other end thereof is connected to the source electrode of the drive transistor 22 (the anode electrode of the organic EL element 21**).

In the pixel 20 having such a configuration, the write transistor 23 enters the conductive state in response to the scan signal WS applied to the gate electrode thereof from the write scan circuit 40 via the scan line 31. Thereby, the write transistor 23 samples the signal voltage (input signal voltage) Vsig or the offset voltage Vofs of the video signal, which is supplied from the horizontal drive circuit 60 via the signal line 33 and which depends on luminance information, and writes the sampled voltage in the pixel 20. This written input signal voltage Vsig or offset voltage Vofs is held in the holding capacitor 24.

When the potential DS of the power supply line 32 (32-1 to **32-*m*) is at the first potential Vccp, the drive transistor 22 is supplied with current from the power supply line 32 and supplies the organic EL element 21 with drive current having the current value dependent upon the voltage value of the input signal voltage Vsig held in the holding capacitor 24, thereby to drive the organic EL element 21** by the current.

(Pixel Structure)

Figure 3:
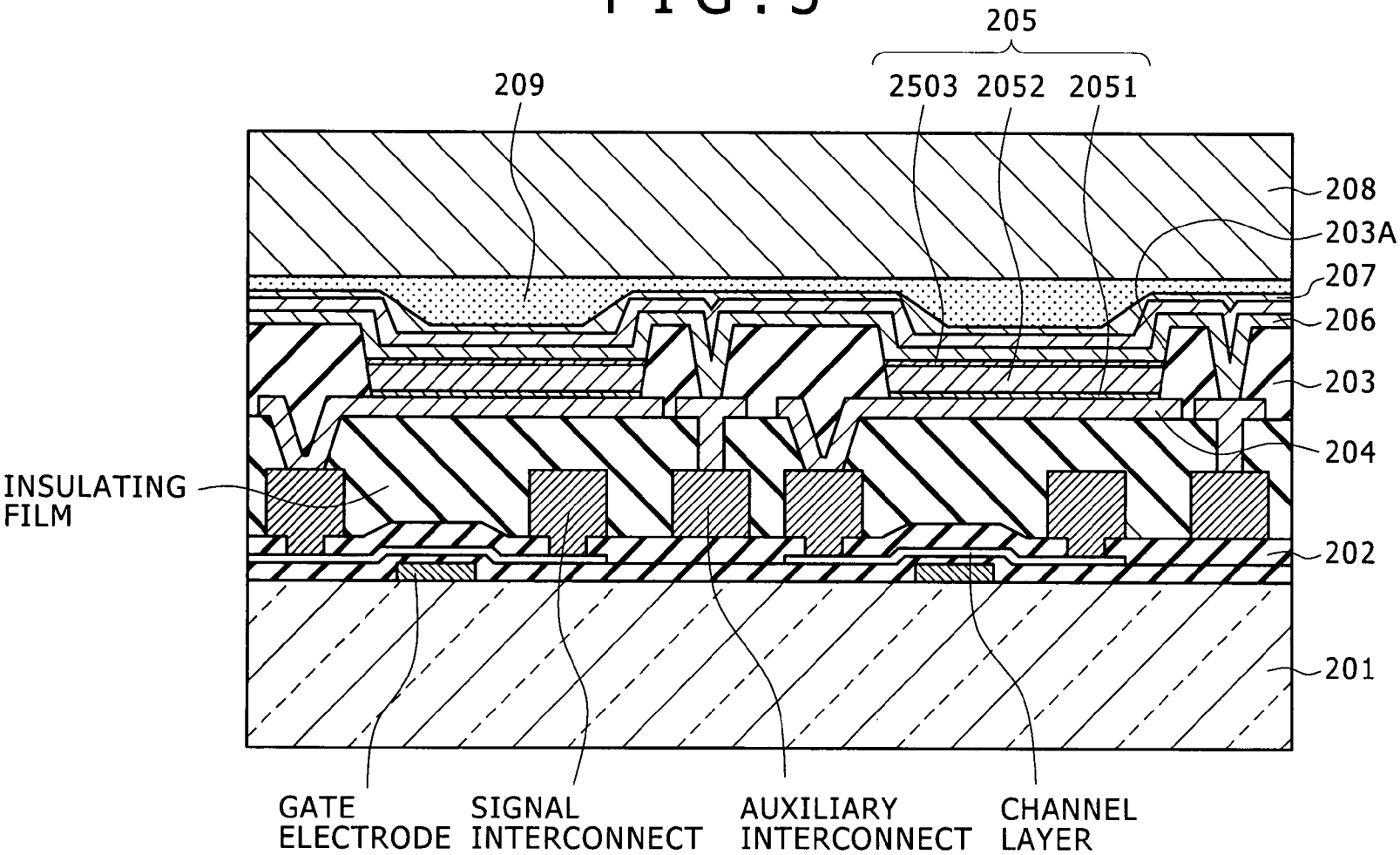
FIG. 3 is a sectional view showing one example of the sectional structure of the pixel.

FIG. 3 shows one example of the sectional structure of the pixel 20. As shown in FIG. 3, the pixel 20 has a structure in which an insulating film 202 and a window insulating film 203 are formed over a glass substrate 201 on which the pixel circuit composed of the drive transistor 22, the write transistor 23, and so on is formed, and the organic EL element 21 is provided in a recess 203A of the window insulating film 203.

The organic EL element 21 is composed of an anode electrode 204 that is formed at the bottom of the recess 203A of the window insulating film 203 and is composed of a metal or the like, an organic layer (electron transport layer, light-emitting layer, hole transport layer/hole injection layer) 205 formed on the anode electrode 204, and a cathode electrode 206 that is formed on the organic layer 205 in common to all the pixels and is formed of a transparent conductive film or the like.

In this organic EL element 21, the organic layer 205 is formed by sequentially depositing over the anode electrode 204 a hole transport layer/hole injection layer 2051, a light-emitting layer 2052, an electron transport layer 2053, and an electron injection layer (not shown). Under driving by current by the drive transistor 22 of FIG. 2, current flows through the organic layer 205 from the drive transistor 22 via the anode electrode 204. This causes the recombination between electrons and holes in the light-emitting layer 2052 in the organic layer 205, and light is emitted in response to this recombination.

As shown in FIG. 3, after the organic EL element 21 is formed for each pixel over the glass substrate 201 on which the pixel circuit is formed with the intermediary of the insulating film 202 and the window insulating film 203, a sealing substrate 208 is bonded by an adhesive 209 with the intermediary of a passivation film 207, so that the organic EL element 21 is sealed by the sealing substrate 208. This completes the display panel 70.

(Threshold Correction Function)

In the period during which the horizontal drive circuit 60 supplies the offset voltage Vofs to the signal line 33 (33-1 to **33-*m*) after the write transistor 23 enters the conductive state, the power supply scan circuit 50 switches the potential DS of the power supply line 32 between the first potential Vccp and the second potential Vini. Due to the switching of the potential DS of the power supply line 32, the voltage equivalent to the threshold voltage Vth of the drive transistor 22 is held in the holding capacitor 24**.

The holding of the voltage equivalent to the threshold voltage Vth of the drive transistor 22 in the holding capacitor 24 is for the following reason. Due to a variation in the manufacturing process for the drive transistor 22 and a change in the drive transistor 22 over time, there is a variation in transistor characteristics of the drive transistor 22, such as the threshold voltage Vth and the mobility μ, from pixel to pixel. Due to the variation in transistor characteristics, even when the same gate potential is applied to the drive transistor 22, the drain-source current (drive current) Ids varies from pixel to pixel, and this current variation will appear as a variation in the light-emission luminance. In order to cancel (correct) the influence of the variation in the threshold voltage Vth from pixel to pixel, the voltage equivalent to the threshold voltage Vth is held in the holding capacitor 24.

The correction of the threshold voltage Vth of the drive transistor 22 is carried out as follows. Specifically, the threshold voltage Vth is held in the holding capacitor 24 in advance. Due to this operation, in the driving of the drive transistor 22 by the input signal voltage Vsig, the threshold voltage Vth of the drive transistor 22 and the voltage that is held in the holding capacitor 24 and is equivalent to the threshold voltage Vth cancel each other. In other words, the correction of the threshold voltage Vth is carried out.

This corresponds to the threshold correction function. Due to this threshold correction function, even when there are a variation and a change over time in the threshold voltage Vth from pixel to pixel, the light-emission luminance of the organic EL element 21 can be kept constant without being affected by the variation and the change over time. The principle of the threshold correction will be described in detail later.

(Mobility Correction Function)

The pixel 20 shown in FIG. 2 is provided with the mobility correction function in addition to the above-described threshold correction function. Specifically, during the period when the horizontal drive circuit 60 supplies the signal voltage Vsig of the video signal to the signal line 33 (33-1 to **33-*n*) and the write transistor 23 is in the conductive state in response to the scan signal WS (WS1 to WSm) output from the write scan circuit 40, i.e., during the mobility correction period, a mobility correction of cancelling the dependence of the drain-source current Ids of the drive transistor 22 on the mobility μ is carried out in the holding of the input signal voltage Vsig in the holding capacitor 24**. The specific principle and operation of this mobility correction will be described later.

(Bootstrap Function)

The pixel 20 shown in FIG. 2 also is provided with a bootstrap function. Specifically, at the timing when the input signal voltage Vsig has been held in the holding capacitor 24, the write scan circuit 40 stops the supply of the scan signal WS (WS1 to WSm) to the scan line 31 (31-1 to **31-*m*) to thereby switch the write transistor 23 to the non-conductive state for electrically isolating the gate of the drive transistor 22 from the signal line 33 (33-1 to 33-*n*). This allows the gate potential Vg of the drive transistor 22 to change in linkage with the source potential Vs, which can keep constant the gate-source voltage Vgs of the drive transistor 22**.

Specifically, even when the I-V characteristic of the organic EL element 21 has changed over time, and correspondingly the source potential Vs of the drive transistor 22 has changed, the gate-source voltage Vgs of the drive transistor 22 is kept constant due to the operation of the holding capacitor 24. Thus, the current flowing through the organic EL element 21 does not change, and hence the light-emission luminance of the organic EL element 21 also is kept constant. The operation for this luminance correction is equivalent to the bootstrap operation. Due to this bootstrap operation, even when the I-V characteristic of the organic EL element 21 changes over time, image displaying without luminance deterioration accompanying the change over time is permitted.

As is apparent from the above description, the write scan circuit 40 and the power supply scan circuit 50 serve as a drive circuit that selectively scans the pixels 20 in the pixel array part 30 on a row-by-row basis, and carries out the respective correction operations of threshold correction against variation in the threshold voltage Vth of the drive transistor 22 and mobility correction against variation in the mobility p of the drive transistor 22, for each selected row with a cycle of 1 H.

[Feature of Present Embodiment]

The organic EL display 10 having the correction functions for threshold correction and mobility correction as described above according to the present embodiment has the following feature. Specifically, for the execution of the respective correction operations for threshold correction and mobility correction with a cycle of 1 H (H denotes horizontal scanning period/horizontal synchronizing cycle) for each pixel row selected by the vertical scanning (hereinafter, referred to as a "correction-target pixel row"), the operation of threshold correction preparation in which the gate potential Vg and source potential Vs of the drive transistor 22 are fixed at the respective predetermined potentials is carried out over plural H periods previous to the start of the 1-H period of the correction-target pixel row and in the periods during which the input signal voltage Vsig is not supplied to the signal line 33 (33-1 to **33-*n***).

(Circuit Operation of Organic EL Display)

The circuit operation of the organic EL display 10 according to the present embodiment will be described below based on the timing chart of FIG. 4 with reference to the operation explanatory diagrams of FIGS. 5 to 7. In the operation explanatory diagrams of FIGS. 5 to 7, the write transistor 23 is represented by a switch symbol for simplification of the drawings. Furthermore, because the organic EL element 21 has a parasitic capacitor Cel, this parasitic capacitor Cel also is shown in these diagrams.

In the timing chart of FIG. 4, changes in the following potentials are shown along the same time axis regarding a certain correction-target pixel row: the potential (scan signal) WS of the scan line 31 (31-1 to **31-*m*); the potential DS of the power supply line 32 (32-1 to 32-*m*); the potential (Vofs/Vsig) of the signal line 33 (33-1 to 33-*n*); and the gate potential Vg and source potential Vs of the drive transistor 22**.

Figure 4:
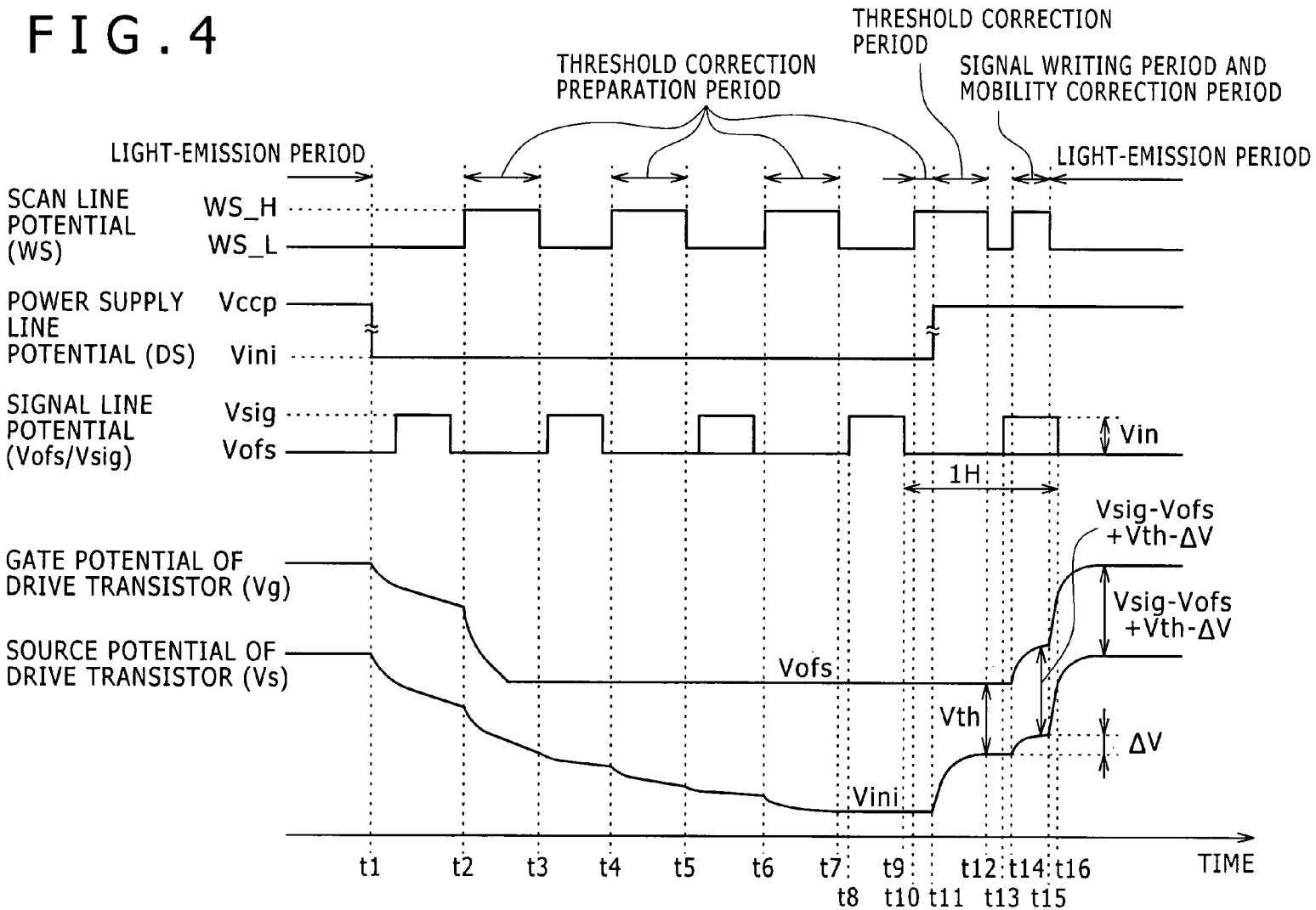
FIG. 4 is a timing chart for explaining the operation of the organic EL display according to the embodiment.

In the timing chart of FIG. 4, the period from time t9 to time t16 corresponds to the 1-H period of the correction-target pixel row, i.e., the 1-H period in which the respective operations of threshold correction, writing of the input signal voltage Vsig, and mobility correction are carried out on the correction-target pixel row.

The time t9 is the timing at which the potential of the signal line 33 is switched from the input signal voltage Vsig to the offset voltage Vofs for the pixel row previous to the correction-target pixel row by one row. The time t16 is the timing at which the potential of the signal line 33 is switched from the input signal voltage Vsig to the offset voltage Vofs for the correction-target pixel row.

<Light-Emission Period>

Figure 5A:
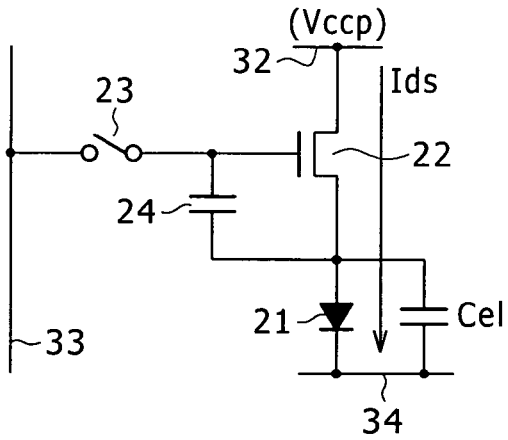
FIGS. 5A to 5C are explanatory diagrams of a circuit operation in the organic EL display according to the embodiment.

According to the timing chart of FIG. 4, the organic EL element 21 is in the light-emission state before time t1 (light-emission period). In this light-emission period, the potential DS of the power supply line 32 is at the higher potential Vccp (first potential), and the write transistor 23 is in the non-conductive state. The drive transistor 22 is designed so as to operate in the saturation region in this period. Therefore, as shown in FIG. 5A, the drive current (drain-source current) Ids dependent upon the gate-source voltage Vgs of the drive transistor 22 is supplied to the organic EL element 21 from the power supply line 32 via the drive transistor 22. This causes the organic EL element 21 to emit light with the luminance dependent upon the current value of the drive current Ids.

<Threshold Correction Preparation Period>

Figure 5B:
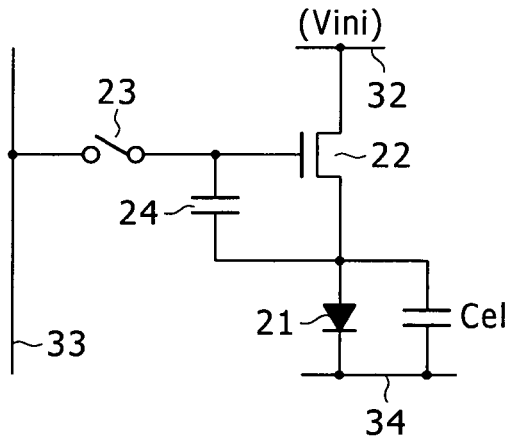

At the time t1, a new field of the line-sequential scanning starts, and as shown in FIG. 5B, the potential DS of the power supply line 32 is switched from the higher potential Vccp to the potential Vini (second potential) which is sufficiently lower than the offset voltage Vofs of the signal line 33. Under the definition that the threshold voltage of the organic EL element 21 is Vel and the potential of the common power supply line 34 is Vcath, if the lower potential Vini is set to satisfy the relationship Vini<Vel+Vcath, the organic EL element 21 enters the reverse-bias state, and thus the light emission thereof stops because the source potential Vs of the drive transistor 22 becomes almost equal to the lower potential Vini.

Figure 5C:
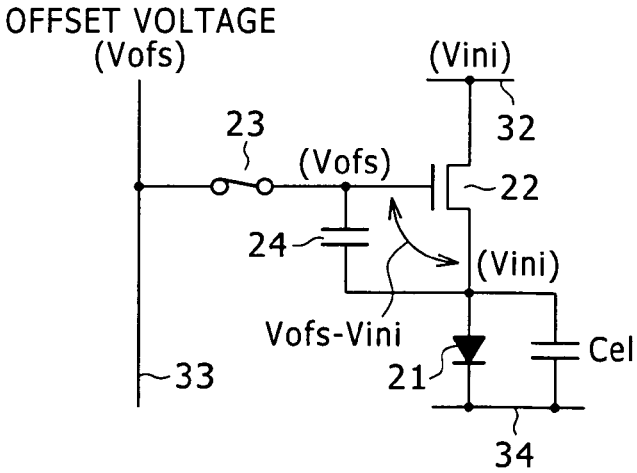

Subsequently, the potential WS of the scan line 31 is switched from a lower potential WS_L to a higher potential WS_H at time t2, so that the write transistor 23 enters the conductive state as shown in FIG. 5C. At this time, the offset voltage Vofs is supplied from the horizontal drive circuit 60 to the signal line 33. Thus, the gate potential Vg of the drive transistor 22 becomes equal to the offset voltage Vofs. The source potential Vs of the drive transistor 22 is at the potential Vini which is sufficiently lower than the offset voltage Vofs.

At this time, the gate-source voltage Vgs of the drive transistor 22 is Vofs−Vini. Unless this voltage Vofs−Vini is higher than the threshold voltage Vth of the drive transistor 22, the above-described threshold correction operation may not be carried out. Thus, the potentials should be designed so as to satisfy the relationship Vofs−Vini>Vth. This operation of fixing (settling) the gate potential Vg of the drive transistor 22 at the offset voltage Vofs and fixing the source potential Vs at the lower potential Vini for initialization in this manner corresponds to the operation of threshold correction preparation.

At the time t3, the potential WS of the scan line 31 is switched from the higher potential WS_H to the lower potential WS_L. This is equivalent to the end of the threshold correction preparation period. The operation of this threshold correction preparation is carried out in the period during which the input signal voltage Vsig is not supplied to the signal line 33, i.e., in the period during which the offset voltage Vofs is supplied to the signal line 33. In the present example, it is carried out in the period t2-t3.

From then on, the same operation of the threshold correction preparation as that in the period t2-t3 is carried out over plural H periods previous to the start of the 1-H period of the correction-target pixel row and in the periods during which the input signal voltage Vsig is not supplied to the signal line 33 (in the periods during which the offset voltage Vofs is supplied to the signal line 33). In the present example, it is carried out intermittently in the periods t4-t5 and t6-t7.

Figure 6A:
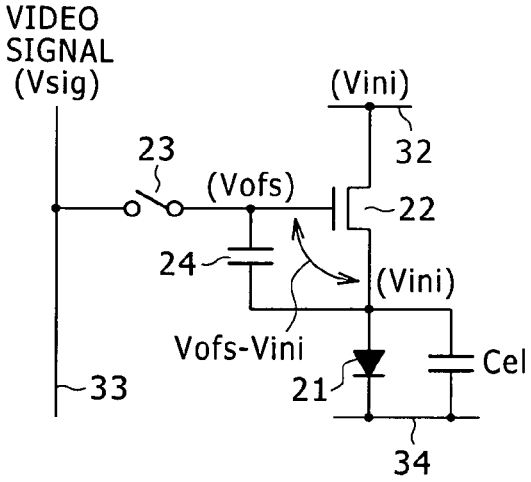
FIGS. 6A to 6C are explanatory diagrams of the circuit operation in the organic EL display according to the embodiment.

Thereafter, at the time t8, in order to carry out the respective operations of signal writing and mobility correction for the pixel row previous to the correction-target pixel row by one row, the potential of the signal line 33 is switched from the offset voltage Vofs to the input signal voltage Vsig. This operation is for the pixel row previous by one row. Therefore, on the correction-target pixel row, the write transistor 23 is in the non-conductive state as shown in FIG. 6A. This feature also applies to the pixel rows previous by two or more rows.

At the time t9, the potential of the signal line 33 is switched from the input signal voltage Vsig to the offset voltage Vofs for the pixel row previous to the correction-target pixel row by one row, so that the 1-H period of the correction-target pixel row starts.

Figure 6B:
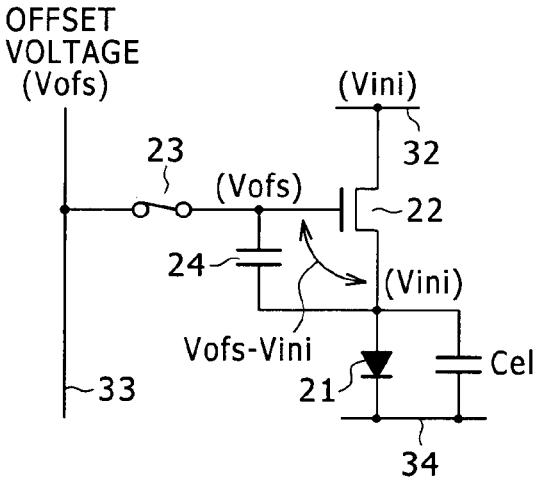

Subsequently, when the potential WS of the scan line 31 is switched from the lower potential WS_L to the higher potential WS_H again at time t10, the write transistor 23 enters the conductive state as shown in FIG. 6B. In the period from time t10 to time t11, the potential WS of the scan line 31, the potential DS of the power supply line 32, and the potential of the signal line 33 (Vofs) are in the same states as those in the respective periods t2-t3, t4-t5, and t6-t7. Therefore, the period t10-t11 also serves as the threshold correction preparation period for fixing the gate potential Vg and source potential Vs of the drive transistor 22 at the offset voltage Vofs and the lower potential Vini, respectively.

<Threshold Correction Period>

Figure 6C:
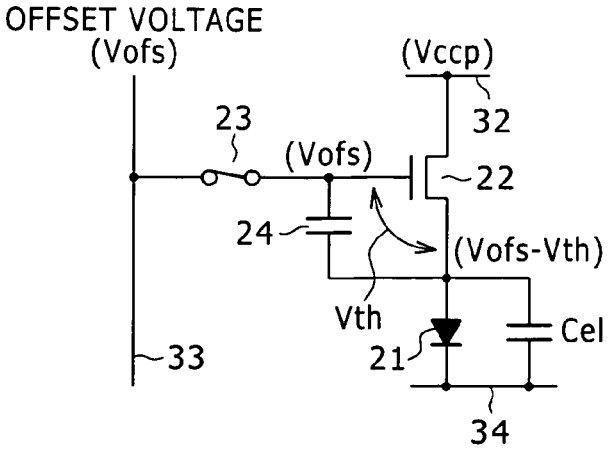

Subsequently, upon switching the potential DS of the power supply line 32 from the lower potential Vini to the higher potential Vccp at the time t11, the source potential Vs of the drive transistor 22 starts to rise because the write transistor 23 is in the conductive state. In due course, as shown in FIG. 6C, the source potential Vs of the drive transistor 22 reaches the potential Vofs−Vth. At this time, the gate-source voltage Vgs of the drive transistor 22 is equal to the threshold voltage Vth of the drive transistor 22, so that the voltage equivalent to this threshold voltage Vth is written to the holding capacitor 24.

In the present specification, for convenience, the period for writing the voltage equivalent to the threshold voltage Vth in the holding capacitor 24 is referred to as the threshold correction period. The potential Vcath of the common power supply line 34 is designed so that the organic EL element 21 is kept at the cut-off state in this threshold correction period in order that current does not flow toward the organic EL element 21 but flows toward the holding capacitor 24 exclusively in the threshold correction period.

Figure 7A:
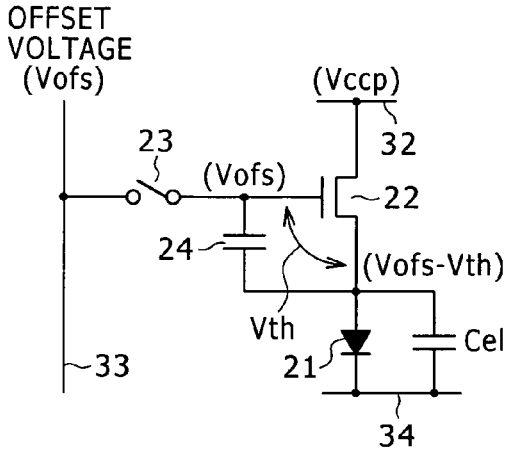
FIGS. 7A to 7C are explanatory diagrams of the circuit operation in the organic EL display according to the embodiment.

Subsequently, the potential WS of the scan line 31 is switched from the higher potential WS_H to the lower potential WS_L at the time t12, so that the write transistor 23 enters the non-conductive state as shown in FIG. 7A. At this time, the gate of the drive transistor 22 becomes the floating state. However, because the gate-source voltage Vgs is equal to the threshold voltage Vth of the drive transistor 22, the drive transistor 22 is in the cut-off state. Therefore, the drain-source current Ids does not flow.

<Writing Period/Mobility Correction Period>

Figure 7B:
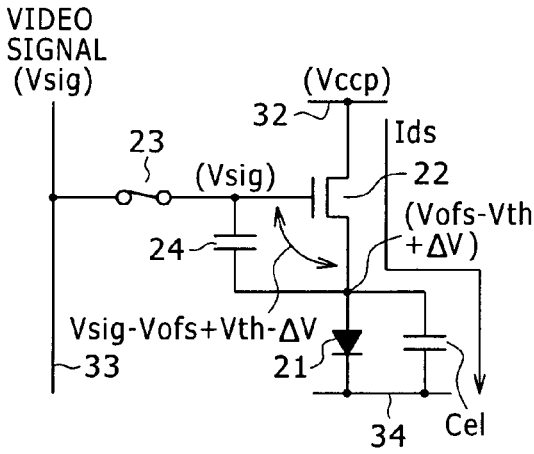

Subsequently, the potential of the signal line 33 is switched from the offset voltage Vofs to the signal voltage Vsig of the video signal at time t13, and then the potential WS of the scan line 31 is switched from the lower potential WS_L to the higher potential WS_H at time t14. Due to this operation, as shown in FIG. 7B, the write transistor 23 enters the conductive state to sample the signal voltage Vsig of the video signal and write the sampled voltage in the pixel 20.

Due to the writing of the input signal voltage Vsig by the write transistor 23, the gate potential Vg of the drive transistor 22 becomes the input signal voltage Vsig. In driving the drive transistor 22 by the input signal voltage Vsig, the threshold voltage Vth of the drive transistor 22 and the voltage that is held in the holding capacitor 24 and is equivalent to the threshold voltage Vth cancel each other, so that the threshold correction is carried out.

At this time, the organic EL element 21 is in the cut-off state (high-impedance state) initially. Therefore, the current (drain-source current Ids) supplied from the power supply through the drive transistor 22 depending on the input signal voltage Vsig flows into the parasitic capacitor Cel of the organic EL element 21, and thus charging of the parasitic capacitor Cel is started.

Due to the charging of the parasitic capacitor Cel, the source potential Vs of the drive transistor 22 rises up along with the elapse of time. At this time, the variation in the threshold voltage Vth of the drive transistor 22 already has been corrected, and the drain-source current Ids of the drive transistor 22 depends on the mobility μ of the drive transistor 22.

In due course, the source potential Vs of the drive transistor 22 rises up to the potential Vofs−Vth+ΔV. At this time, the gate-source voltage Vgs of the drive transistor 22 is equal to Vsig−Vofs+Vth−ΔV. Specifically, the rise of the source potential Vs by the amount ΔV functions to subtract the potential ΔV from the voltage (Vsig−Vofs+Vth) held in the holding capacitor 24. In other words, this potential rise functions to discharge the electric charges in the holding capacitor 24, which is equivalent to a negative feedback. Consequently, the rise amount ΔV of the source potential Vs is equivalent to the feedback amount of the negative feedback.

By thus carrying out the negative feedback of the drain-source current Ids flowing through the drive transistor 22 to the gate input of the drive transistor 22, i.e., to the gate-source voltage Vgs, a mobility correction for cancelling the dependence of the drain-source current Ids of the drive transistor 22 on the mobility μ, i.e., for correcting variation in the mobility μ from pixel to pixel, is carried out.

More specifically, when the signal voltage Vsig of the video signal is higher, the drain-source current Ids is larger, and thus the absolute value of the feedback amount (correction amount) ΔV of the negative feedback also is larger. Therefore, the mobility correction dependent upon the light-emission luminance level is carried out. Furthermore, when the signal voltage Vsig of the video signal is constant, because a higher mobility p of the drive transistor 22 provides a larger absolute value of the feedback amount ΔV of the negative feedback, a variation in the mobility μ from pixel to pixel can be eliminated.

<Light-Emission Period>

Figure 7C:
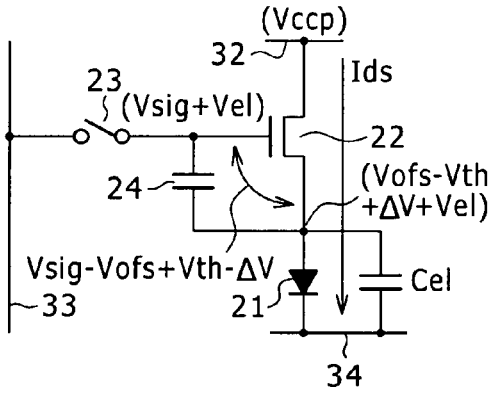

Subsequently, the potential WS of the scan line 31 is switched from the higher potential WS_H to the lower potential WS_L at the time t15, so that the write transistor 23 enters the non-conductive state as shown in FIG. 7C. This isolates the gate of the drive transistor 22 from the signal line 33. Simultaneously, the drain-source current Ids starts flowing through the organic EL element 21, which raises the anode potential of the organic EL element 21 depending on the drain-source current Ids.

The rise of the anode potential of the organic EL element 21 is equivalent to the rise of the source potential Vs of the drive transistor 22. In linkage with the rise of the source potential Vs of the drive transistor 22, the gate potential Vg of the drive transistor 22 also rises up due to the bootstrap operation of the holding capacitor 24. The rise amount of the gate potential Vg is equal to that of the source potential Vs. Therefore, during the light-emission period, the gate-source voltage Vgs of the drive transistor 22 is kept constant at Vsig−Vofs+Vth−ΔV. At the time t16, the potential of the signal line 33 is switched from the signal voltage Vsig of the video signal to the offset voltage Vofs.

(Principle of Threshold Correction)

The principle of the threshold correction for the drive transistor 22 will be described below. The drive transistor 22 operates as a constant current source because it is designed so as to operate in the saturation region. Thus, the constant drain-source current (drive current) Ids represented by Equation (1) is supplied from the drive transistor 22 to the organic EL element 21.

$$Ids=(1/2)\cdot\mu(W/L)Cox(Vgs-Vth)^2 \quad (1)$$

In Equation (1), W denotes the channel width of the drive transistor 22, L denotes the channel length thereof, and Cox denotes the gate capacitance per unit area.

Figure 8:
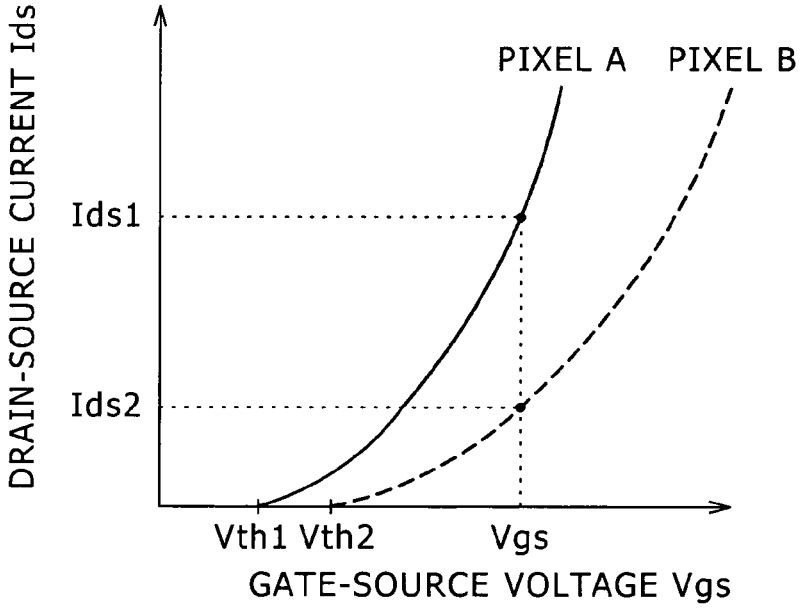
FIG. 8 is a characteristic diagram for explaining a problem due to variation in threshold voltage Vth of a drive transistor.

FIG. 8 shows the characteristic of the drain-source current Ids vs. the gate-source voltage Vgs of the drive transistor 22. As shown in this characteristic diagram, unless a correction against variation in the threshold voltage Vth of the drive transistor 22 is carried out, the same voltage Vgs provides the different currents Ids. Specifically, when the threshold voltage Vth is Vth1, the drain-source current Ids corresponding to the gate-source voltage Vgs is Ids1. On the other hand, when the threshold voltage Vth is Vth2 (Vth2>Vth1), the drain-source current Ids corresponding to the same gate-source voltage Vgs is Ids2 (Ids2<Ids1). That is, if there is variation in the threshold voltage Vth of the drive transistor 22, the drain-source current Ids varies even when the gate-source voltage Vgs is constant.

In contrast, in the pixel (pixel circuit) 20 having the above-described configuration, the gate-source voltage Vgs of the drive transistor 22 in the light-emission state is Vsig−Vofs+Vth−ΔV as described above. Therefore, the drain-source current Ids is represented by Equation (2), which is obtained by substituting this voltage for Vgs in Equation (1).

$$Ids=(1/2)\cdot\mu(W/L)Cox(Vsig-Vofs-\Delta V)^2 \quad (2)$$

That is, the term of the threshold voltage Vth of the drive transistor 22 is cancelled, and thus the drain-source current Ids supplied from the drive transistor 22 to the organic EL element 21 does not depend on the threshold voltage Vth of the drive transistor 22. As a result, even when the threshold voltage Vth of the drive transistor 22 varies from pixel to pixel due to a variation in the manufacturing process for the drive transistor 22 and changes in the drive transistor 22 over time, the drain-source current Ids will not vary, and hence the light-emission luminance of the organic EL element 21 also will not vary.

(Principle of Mobility Correction)

Figure 9:
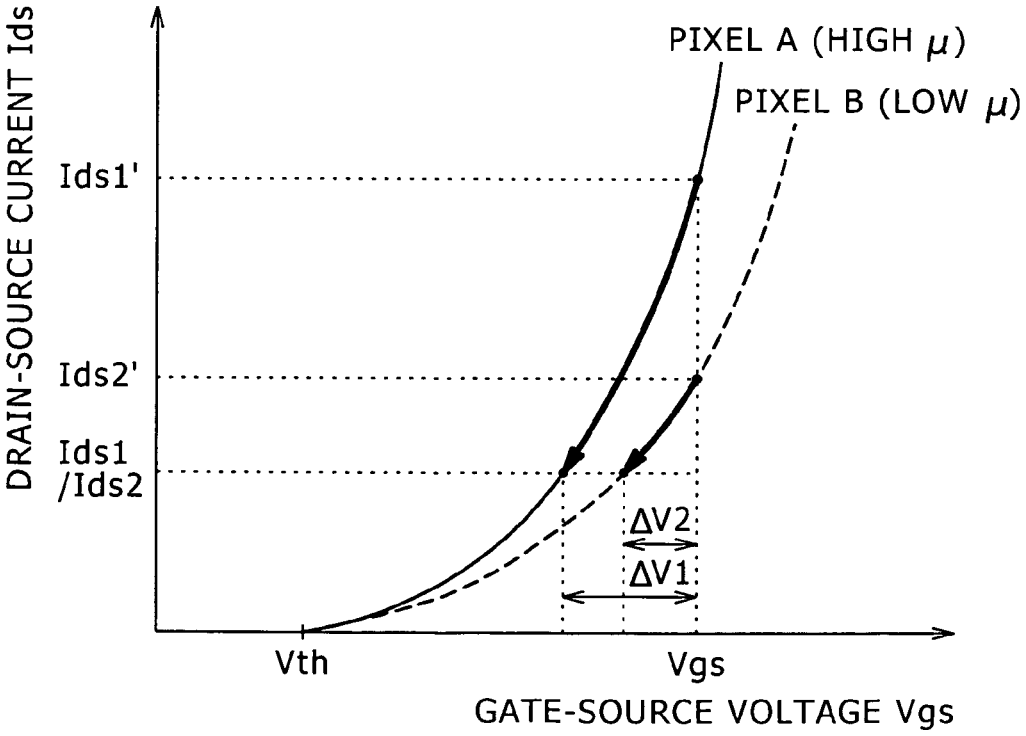
FIG. 9 is a characteristic diagram for explaining a problem due to variation in mobility μ of the drive transistor.

The principle of the mobility correction for the drive transistor 22 will be described below. FIG. 9 shows characteristic curves for comparison between a pixel A in which the mobility μ of the drive transistor 22 is relatively high and a pixel B in which the mobility μ of the drive transistor 22 is relatively low. If the drive transistor 22 is formed of a poly-silicon thin film transistor or the like, it is inevitable that the mobility μ varies from pixel to pixel like the mobility difference between pixel A and pixel B.

If the input signal voltage Vsig of the same level is written to both the pixels A and B, for example, in the state in which the mobility μ is different between the pixel A and the pixel B, no correction of the mobility μ yields a large difference between the drain-source current Ids1' flowing through the pixel A in which the mobility μ is high and the drain-source current Ids2' flowing through the pixel B in which the mobility μ is low. The occurrence of such a large difference in the drain-source current Ids between pixels attributed to variation in the mobility μ will lower the uniformity of the screen.

As is apparent from the above-described transistor characteristic equation (1), a higher mobility μ provides a larger drain-source current Ids. Therefore, the higher the mobility μ is, the larger the feedback amount ΔV of the negative feedback is. As shown in FIG. 9, the feedback amount ΔV1 of the pixel A having high mobility p is larger than the feedback amount ΔV2 of the pixel B having low mobility μ. Thus, by carrying out negative feedback of the drain-source current Ids of the drive transistor 22 to the input signal voltage Vsig by the mobility correction operation, a variation in the mobility μ can be suppressed because a higher mobility p provides a higher degree of negative feedback.

Specifically, due to the correction by the feedback amount ΔV1 for the pixel A having high mobility μ, the drain-source current Ids therein is greatly decreased from Ids1' to Ids1. On the other hand, because the feedback amount ΔV2 of the pixel B having low mobility p is small, the decrease in the drain-source current Ids therein is not so large, from Ids2' to Ids2. As a result, the drain-source current Ids1 of the pixel A and the drain-source current Ids2 of the pixel B become almost equal to each other, so that the variation in mobility p is corrected.

Summarizing the above, when there are the pixel A and the pixel B having different mobilities μ, the feedback amount ΔV1 of the pixel A having high mobility p is larger than the feedback amount ΔV2 of the pixel B having low mobility μ. That is, in a pixel with higher mobility μ, the feedback amount ΔV is larger, and thus the decrease amount of the drain-source current Ids is larger. Consequently, through the negative feedback of the drain-source current Ids of the drive transistor 22 to the input signal voltage Vsig, the current values of the drain-source currents Ids in pixels having different mobility μ are equalized. As a result, the variation in the mobility μ can be corrected.

With use of FIGS. 10A to 10C, a description will be given below about the relationships between the signal potential (sampling potential) Vsig of the video signal and the drain-source current Ids of the drive transistor 22 in the pixel (pixel circuit) 20 shown in FIG. 2, in association with the presence/absence of the threshold correction and the mobility correction.

Figure 10A:
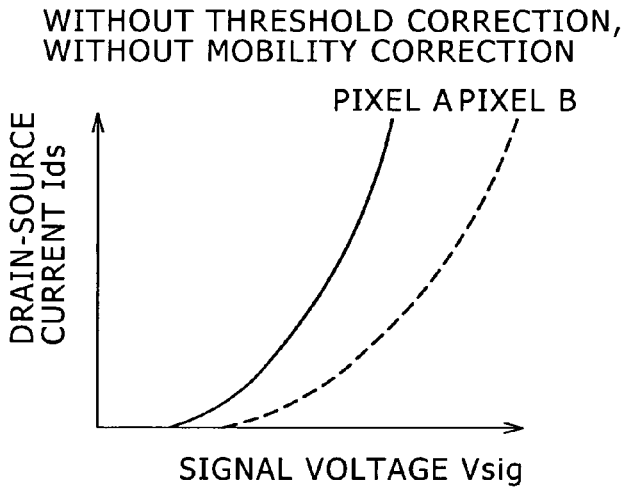
FIGS. 10A to 10C are characteristic diagrams for explaining the relationship between signal voltage Vsig of a video signal and drain-source current Ids of the drive transistor in association with the presence/absence of threshold correction and mobility correction.

FIG. 10A shows the case in which neither the threshold correction nor the mobility correction is carried out. FIG. 10B shows the case in which the mobility correction is not carried out but only the threshold correction is carried out. FIG. 10C shows the case in which both the threshold correction and the mobility correction are carried out. As shown in FIG. 10A, if neither the threshold correction nor the mobility correction is carried out, a large difference in the drain-source current Ids arises between the pixels A and B attributed to a variation in the threshold voltage Vth and the mobility μ between the pixels A and B.

Figure 10B:
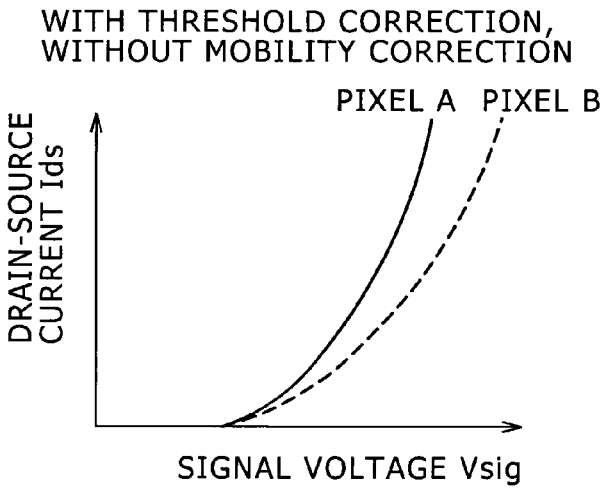

In contrast, if only the threshold correction is carried out, a variation in the drain-source current Ids can be decreased to some extent by the threshold correction as shown in FIG. 10B. However, a difference in the drain-source current Ids between the pixels A and B still remains attributable to a variation in the mobility μ between the pixels A and B.

Figure 10C:
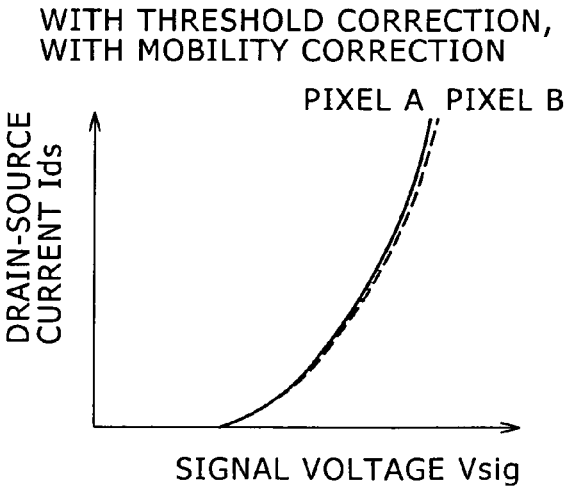

If both the threshold correction and the mobility correction are carried out, as shown in FIG. 10C, the difference in the drain-source current Ids between the pixels A and B attributed to a variation in the threshold voltage Vth and the mobility μ between the pixels A and B can be substantially eliminated. Thus, a variation in the luminance of the organic EL element 21 does not arise at any grayscale, which can provide a display having a favorable image quality.

(Advantageous Effects of Present Embodiment)

As described above, the present embodiment provides an improved drive scheme for execution of the respective correction operations of threshold correction and mobility correction on each correction-target pixel row with a cycle of 1 H in the organic EL display 10 having the correction functions for threshold correction and mobility correction. Specifically, in the embodiment, the operation of threshold correction preparation is carried out before the start of the 1-H period of the correction-target pixel row. More specifically, in this operation, the gate potential Vg and source potential Vs of the drive transistor 22 are fixed at the respective predetermined potentials, such as the offset voltage Vofs and the lower potential Vini, respectively. This feature eliminates the need to ensure the threshold correction preparation period in the 1-H period of the correction-target pixel row, and thus it can correspondingly extend the correction periods for threshold correction and mobility correction.

Thus, as the respective correction periods for threshold correction and mobility correction, sufficiently-long times to carry out the respective correction operations surely can be ensured. This can sufficiently suppress the age deterioration of the organic EL element 21 and the variation in transistor characteristics of the drive transistor 22, such as the threshold voltage Vth and the mobility μ, attributed to a variation in the manufacturing process for the drive transistor 22 and changes in the drive transistor 22 over time. Therefore, a display having an uniform image quality without unevenness and shading can be achieved.

This drive scheme of carrying out the operation of the threshold correction preparation before the start of the 1-H period of the correction-target pixel row is particularly suitable for the following displays.

As one example, calls are increasing for high-definition displays as displays incorporated in mobile apparatuses, such as a cellular phone, which display small maps and characters. Along with an enhancement in the display definition, the horizontal scanning period (1 H) becomes shorter, and thus it is becoming difficult to sufficiently ensure the respective correction times for threshold correction and mobility correction.

Also, for such an organic EL display having an increased number of pixels and a correspondingly-shortened 1-H period due to enhancement in the display definition, the drive scheme of carrying out the operation of the threshold correction preparation before the start of the 1-H period of the correction-target pixel row is effective. Specifically, also for such an organic EL display, the age deterioration of the organic EL element 21 and the variation in characteristics of the drive transistor 22 can be suppressed by ensuring sufficiently-long times as the respective correction periods for the threshold correction and the mobility correction with use of the drive scheme. Thus, a display having a favorable image quality can be achieved.

Moreover, also for such an organic EL display having the pixel 20 in which a transistor having low mobility μ, such as an amorphous silicon (a-Si) transistor is used for cost reduction, the drive scheme of carrying out the operation of the threshold correction preparation before the start of the 1-H period of the correction-target pixel row is effective. Specifically, also for such an organic EL display, the age deterioration of the organic EL element 21 and the variation in characteristics of the drive transistor 22 can be suppressed by ensuring sufficiently-long times as the respective correction periods for the threshold correction and the mobility correction with use of the drive scheme. Thus, a display having a favorable image quality can be achieved.

As another way of carrying out the operation of the threshold correction preparation before the start of the 1-H period of the correction-target pixel row, it also would be possible to carry out the operation of the threshold correction preparation continuously over plural H periods previous to the start of the 1-H period. Specifically, in the case of the above-described example, the operation is carried out continuously over the period from the time t2 to the time t7 in FIG. 4. However, this way causes the following problem.

Specifically, in a pixel circuit in which a transistor having low mobility μ such as a a-Si transistor is used, it takes a long time for the source potential Vs of the drive transistor 22 to be fixed at the lower potential Vini in the threshold correction preparation period because the amount of the current that can flow through the drive transistor 22 is small. Therefore, there is a need to set a very long time as the threshold correction preparation period for the pixel circuit in which a transistor having low mobility μ such as a a-Si transistor is used.

Figure 11:
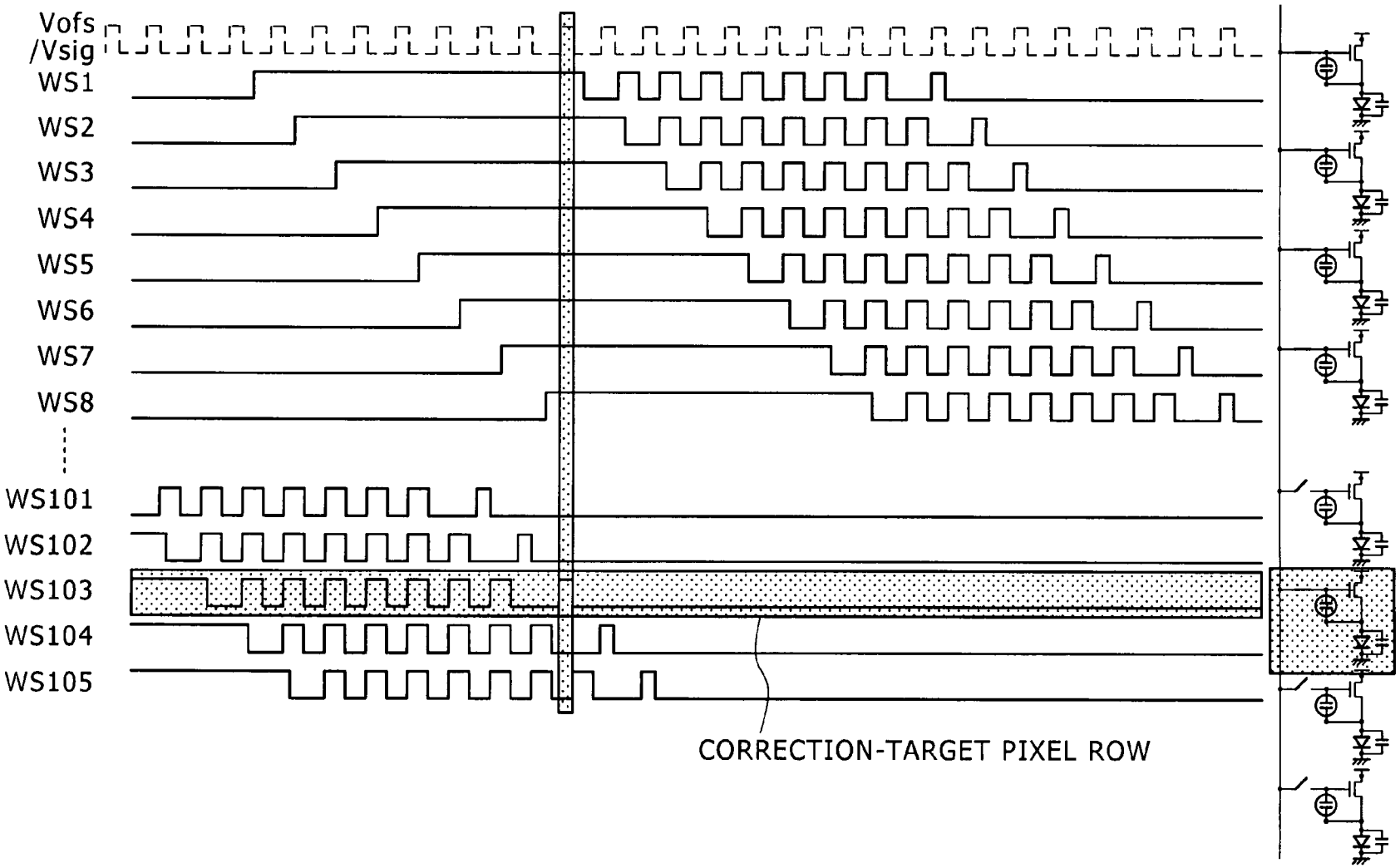
FIG. 11 is a timing chart for explaining an operation when operation of threshold correction preparation is carried out continuously over plural H periods.
Figure 12:
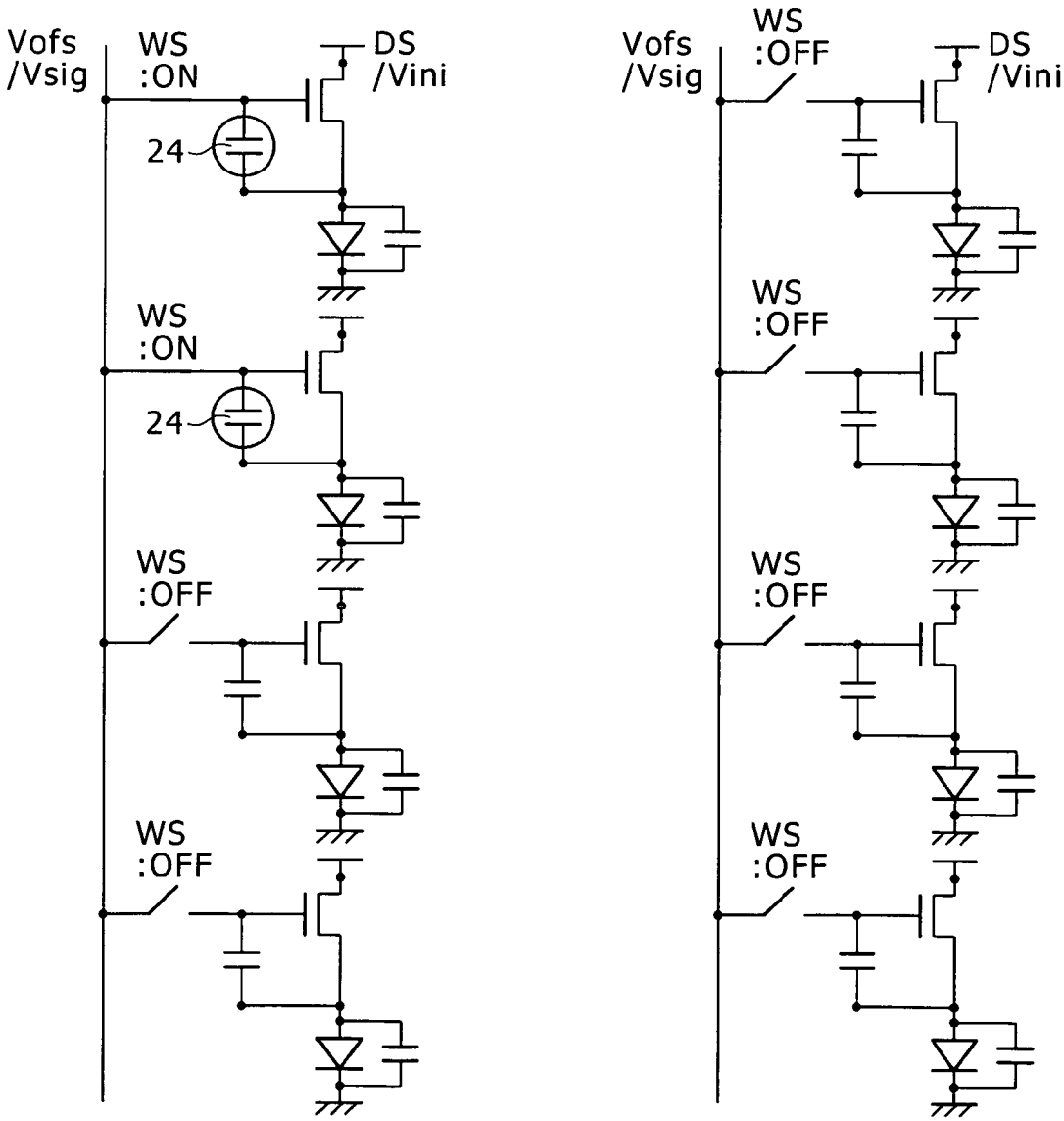
FIG. 12 is a diagram schematically showing the continuous execution of the operation of the threshold correction preparation over plural H periods.

Setting the long preparation period makes it possible to fix the gate potential Vg and source potential Vs of the drive transistor 22 at the offset voltage Vofs and the lower potential Vini, respectively, as the preparation for the threshold correction. In this case, however, as shown in FIG. 11, a number of pixels for which the potential WS (WS1 to WSm) of the scan line 31 (31-1 to **31-*m*) is in the state of the higher potential WS_H (hereinafter, referred to as "the ON state") will exist along the signal line 33 (33-1 to 33-*n*) at the same timing. FIG. 12** schematically shows this state.

In this manner, if a long time is set as the threshold correction preparation period, a number of pixels for which the potential WS of the scan line 31 is in the ON state will exist on the same signal line. As a result, the capacitances of the holding capacitors 24 in the respective pixels 20 will be added to the capacitance of the signal line 33 (33-1 to **33-*n*). Thus, the capacitance of the signal line 33 is increased and the transient of the signal line 33 is increased. This causes the corruption of the rising-edge waveform/falling-edge waveform of the input signal voltage Vsig applied to the signal line 33**.

In particular, in a high-definition display in which the 1-H period is short, a large number of pixels for which the potential WS of the scan line 31 is in the ON state will exist on the same signal line, because the time necessary as the threshold correction preparation period in this display is the same as that in a display having a long 1-H period. Thus, the capacitance of the signal line 33 is greatly increased, which results in a higher degree of waveform corruption of the input signal voltage Vsig.

For example, in the case of carrying out mobility correction simultaneously with writing of the input signal voltage Vsig, a high degree of corruption of the rising-edge waveform of the input signal voltage Vsig causes a problem that the mobility correction is started in the state in which the writing of the input signal voltage Vsig is insufficient. This results in a variation in the mobility correction among the pixels, which deteriorates the image quality.

In contrast, in the organic EL display 10 according to the present embodiment, the operation of the threshold correction preparation is not carried out continuously over plural H periods previous to the start of the 1-H period of the correction-target pixel row. Instead of the continuous execution, as is particularly apparent from the timing chart of FIG. 4, the operation is carried out intermittently in the periods during which the signal voltage Vsig of the video signal is not supplied to the signal line 33, i.e., in the periods during which the offset voltage Vofs is supplied to the signal line 33, over plural H periods previous to the start of the 1-H period of the correction-target pixel row.

If the operation of the threshold correction preparation is thus intermittently carried out when the potential of the signal line 33 is at the offset voltage Vofs (when the input signal voltage Vsig is not supplied to the signal line 33) over plural H periods previous to the start of the 1-H period of the correction-target pixel row, the following advantage is obtained.

Figure 13:
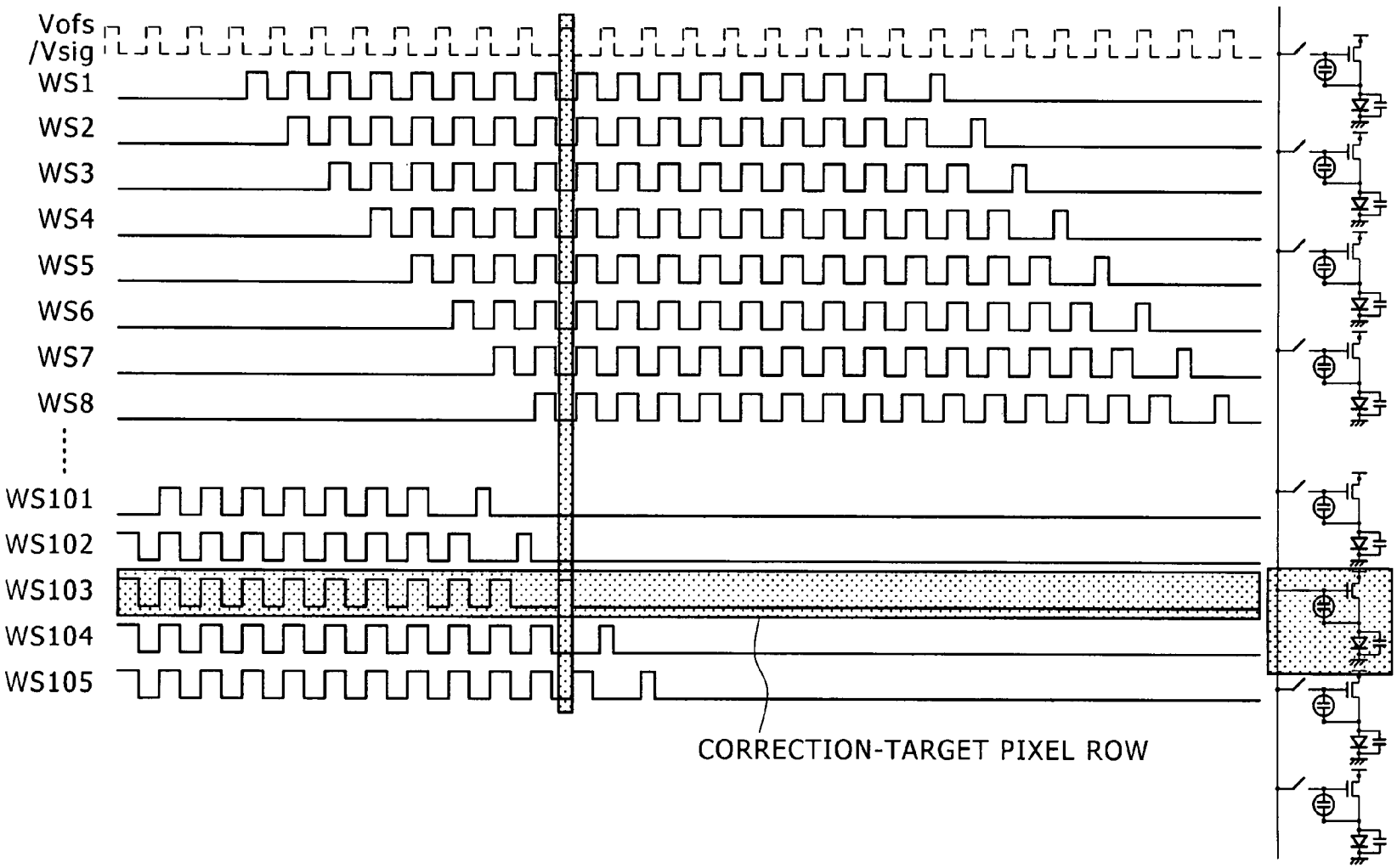
FIG. 13 is a timing chart for explaining an operation when the operation of the threshold correction preparation is carried out intermittently over plural H periods when the potential of a signal line is at an offset voltage Vofs.

Specifically, as shown in FIG. 13, at the timing when the potential of the signal line 33 of the correction-target pixel row is switched from the offset voltage Vofs to the signal voltage Vsig of the video signal, the potentials WS of the scan lines 31 of all the other pixel rows are in the state of the lower potential WS_L (OFF state). That is, when the signal voltage Vsig of the video signal is being written on the correction-target pixel row, all the other pixel rows are in the non-writing state. Thus, an increase in the capacitance of the signal line 33 can be prevented, unlike the case of continuously carrying out the operation of the threshold correction preparation over plural H periods.

Due to this feature, even in an organic EL display having the pixel 20 in which a transistor having low mobility μ, such as an a-Si transistor, is used for cost reduction and an organic EL display in which the 1-H period is short corresponding to definition enhancement, the operation of the threshold correction preparation can be carried out surely by sufficiently ensuring the threshold correction preparation period, with the capacitance of the signal line 33 prevented from increasing. Thus, the age deterioration of the organic EL element 21 and the variation in characteristics of the drive transistor 22 can be suppressed, and therefore a display having a favorable image quality can be achieved.

<Organic EL Display of Selector System>

The organic EL display 10 according to the above-described embodiment has a configuration in which the horizontal drive circuit 60 is mounted on the display panel 70, as an example. Alternatively, it is also possible for the display 10 to employ a configuration in which the horizontal drive circuit 60 is provided outside the display panel 70 and the video signal is supplied from the outside of the panel via an external interconnect to a signal line 30 (30-1 to **30-*n*) on the display panel 70**.

In the case of thus employing a configuration in which the video signal is input from the outside of the panel, if the external interconnects and the signal lines are provided for each of red (R), green (G), and blue (B) separately, a full HD (high definition) display having a resolution of (1920×1080) entails as large as 5760 (=1920×3) interconnects as the external interconnects.

In contrast, in order to reduce the number of external interconnects, a so-called selector drive system (or time-division drive system) is employed. In this system, plural signal lines on the display panel are allocated as one unit (group) to a respective one of the outputs of a driver IC outside the panel. Furthermore, the signal lines are driven in such a way that a respective one of the plural signal lines is sequentially selected based on time division and the video signal output from each output of the driver IC in a time-series manner is distributed to the selected signal line based on the time division.

Specifically, in the selector drive system, the relationship between the outputs of the driver IC and the signal lines on the display panel is so designed that the outputs and the signal lines have a correspondence relationship of 1 to x (x is an integer number equal to or larger than two), and a respective one of x signal lines allocated to one output of the driver IC is selected and driven based on a x time division. Employing this selector drive system can reduce the number of outputs of the driver IC and the number of external interconnects to 1/x of the number of signal lines.

Figure 14:
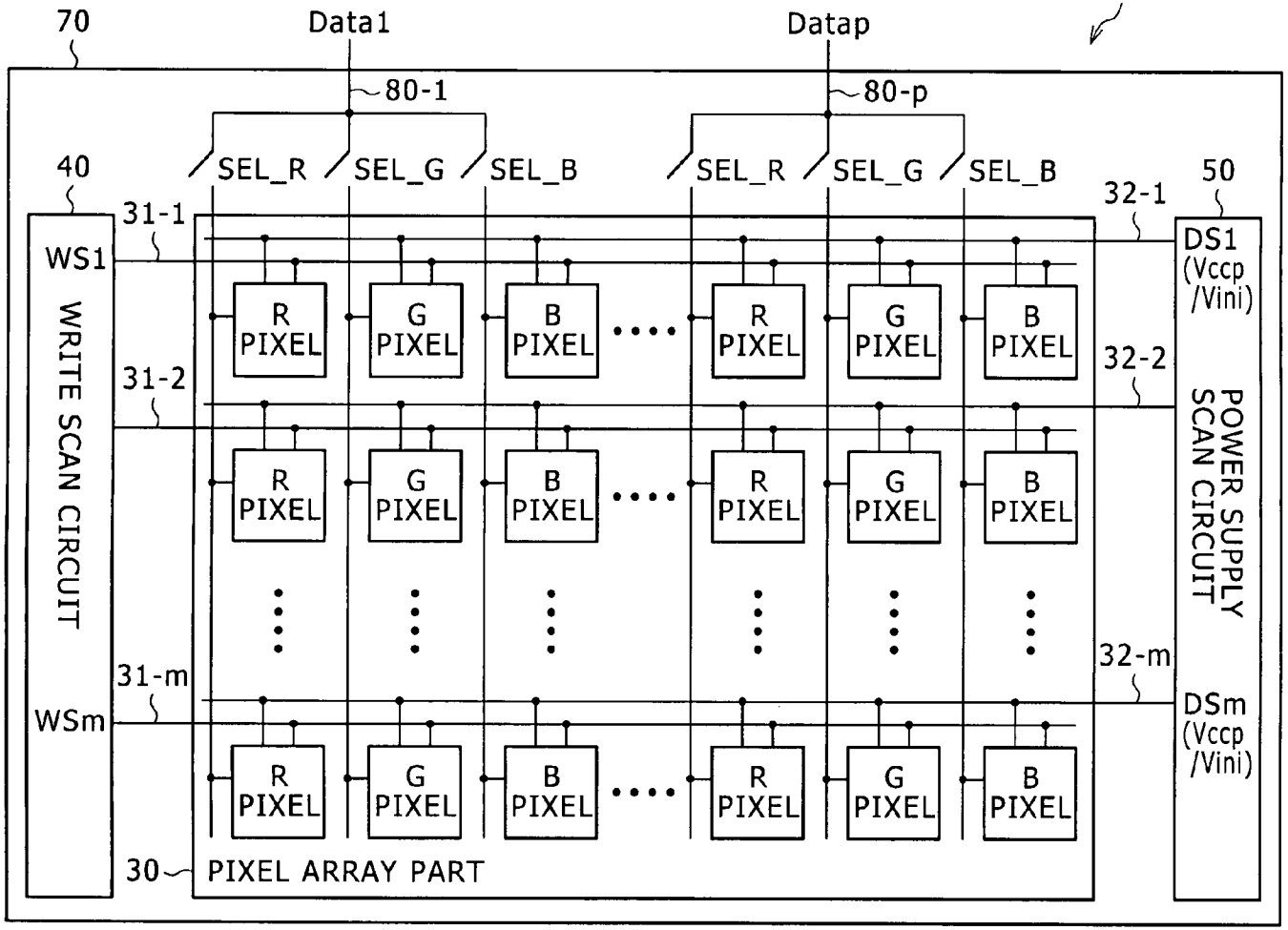
FIG. 14 is a system configuration diagram showing the schematic configuration of an organic EL display employing a selector drive system.

As one example, the selector drive system shown in FIG. 14 is available. In this system, three-color pixels R, G, and B horizontally arranged are defined as one unit, and video signals Data1 to Datap each corresponding to these three-color pixels are input in a time-series manner within the 1-H period. Furthermore, selector switches SEL_R, SEL_G, and SEL_B disposed in units of three pixels are in turn switch-driven in units of three pixels to thereby write the video signals Data1 to Datap. Employing this selector drive system provides an advantage that the number p of external interconnects 80-1 to **80-*p* can be set to 1/x of the number n of signal lines 33-1 to 33-*n***.

However, in the case of an organic EL display employing the selector drive system (time-division drive system), there is a need to write the video signal to three pixels R, G, and B as one unit within the 1-H period, which makes it more difficult to ensure the respective correction times for threshold correction and mobility correction sufficiently.

However, even when there is a need to set the signal-line-potential writing period for writing the signal voltages Vsig of the video signals of R, G, and B in an organic EL display 10' employing a selector drive system in which the video signals are written to three pixels of R, G, and B within the 1-H period as described above, the above-described drive scheme, in which the operation of the threshold correction preparation is carried out before the start of the 1-H period of the correction-target pixel row and specifically, carried out intermittently when the potential of the signal line 33 is at the offset voltage Vofs over plural H periods previous to the start of the 1-H period of the correction-target pixel row, is effective. Specifically, by using the drive scheme, sufficiently-long times can be ensured as the respective correction periods for threshold correction and mobility correction. Thus, the age deterioration of the organic EL element 21 and the variation in characteristics of the drive transistor 22 can be suppressed, which can provide a display having a favorable image quality.

Modification Examples

In the above-described embodiment, the drive scheme is applied to an organic EL display provided with both correction functions for threshold correction and mobility correction, as an example. However, also for an organic EL display that does not have the mobility correction function but has only the threshold correction function, by carrying out the operation of the threshold correction preparation before the start of the 1-H period of the correction-target pixel row, a longer threshold correction period can be ensured compared with the case of carrying out the operation of the threshold correction preparation within the 1-H period of the correction-target pixel row, and thus the threshold correction can be carried out more surely.

Furthermore, in the above-described embodiment, the drive scheme is applied to an organic EL display in which each pixel 20 has two transistors of the drive transistor 22 and the write transistor 23 and the mobility correction is carried out in the period for writing the input signal voltage Vsig, as an example. However, the embodiment is not limited to this application example but can be similarly applied also to an organic EL display having a configuration like that described in, e.g., Patent Document 1, in which each pixel further includes a switching transistor that is connected in series to the drive transistor 22 and controls the light-emission/non-light-emission of the organic EL element 21 and the mobility correction is carried out previous to writing of the input signal voltage Vsig.

However, the configuration in which mobility correction is carried out in the period for writing the input signal voltage Vsig, like that of the organic EL display according to the above-described embodiment, has an advantage that the signal writing period does not need to be ensured separately from the mobility correction period, and thus the respective correction periods for the threshold correction and the mobility correction can be extended correspondingly.

Moreover, in the above-described embodiment, the drive scheme is applied to an organic EL display that employs an organic EL element as an electro-optical element in the pixel circuit 20, as an example. However, the embodiment is not limited to this application example but can be applied to overall displays that employ a current-driven electro-optical element (light-emitting element) whose light-emission luminance varies depending on the value of the current flowing through the element.

Application Examples

The display according to the above-described embodiment can be applied to various kinds of electronic apparatuses as shown in FIGS. 15 to 19 as examples. Specifically, it can be used as a display in an electronic apparatus in any field that displays, as an image or video, a video signal input thereto or a video signal produced therein, such as a digital camera, a notebook personal computer, a portable terminal apparatus typified by a cellular phone, and a video camera. Examples of electronic apparatus to which the embodiment is applied will be described below.

The display according to the embodiment also encompasses a module-shape display with a sealed structure. Examples of such a display include a display module formed by attaching a counterpart composed of transparent glass or the like to the pixel array part 30. This transparent counterpart may be provided with a color filer, a protective film, a light-shielding film, and so on. The display module may be provided with a circuit part, a flexible printed circuit (FPC), and so on for input/output of signals and so forth to/from the pixel array part from/to the external.

Figure 15:
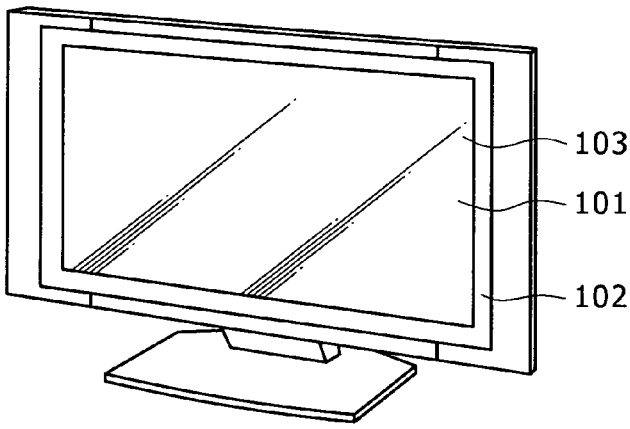
FIG. 15 is a perspective view showing a television to which the embodiment is applied.

FIG. 15 is a perspective view showing a television to which the embodiment is applied. This television includes a video display screen 101 composed of a front panel 102, a filter glass 103, and so on, and is fabricated by using the display according to the embodiment as the video display screen 101.

Figure 16A:
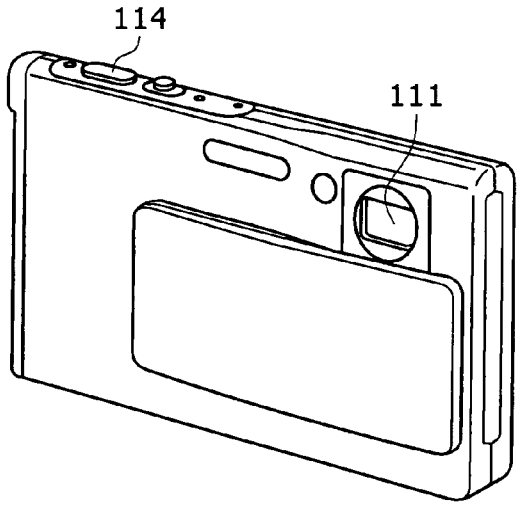
FIGS. 16A and 16B are perspective views showing a digital camera to which the embodiment is applied: FIG. A is a front-side view; and FIG. B is a rear-side view.
Figure 16B:
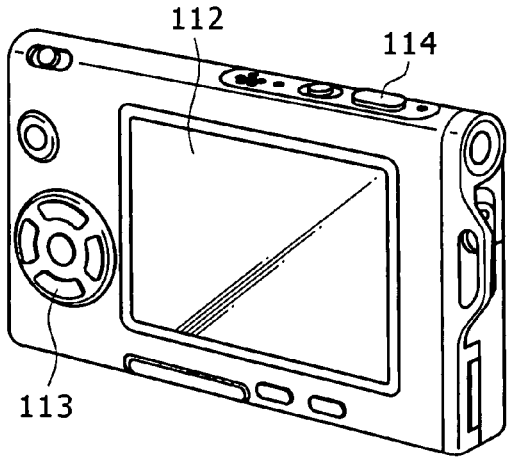

FIGS. 16A and 16B are perspective views showing a digital camera to which the embodiment is applied. FIG. 16A is a front-side view; and FIG. 16B is a rear-side view. This digital camera includes a light emitter 111 for flash, a display part 112, a menu switch 113, a shutter button 114, and so on, and is fabricated by using the display according to the embodiment as the display part 112.

Figure 17:
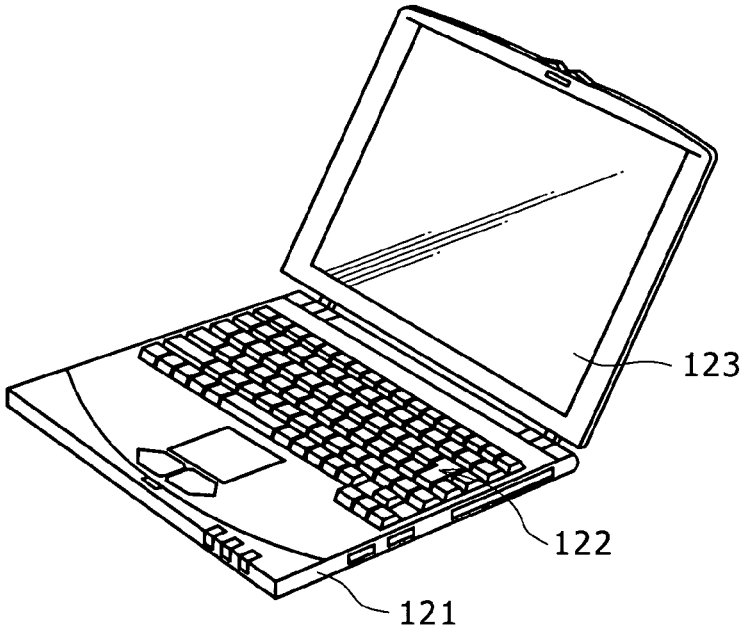
FIG. 17 is a perspective view showing a notebook personal computer to which the embodiment is applied.

FIG. 17 is a perspective view showing a notebook personal computer to which the embodiment is applied. This notebook personal computer includes in its main body 121 a keyboard 122 operated in inputting of characters and so forth, a display part 123 for displaying images, and so on. The notebook personal computer is fabricated by using the display according to the embodiment as the display part 123.

Figure 18:
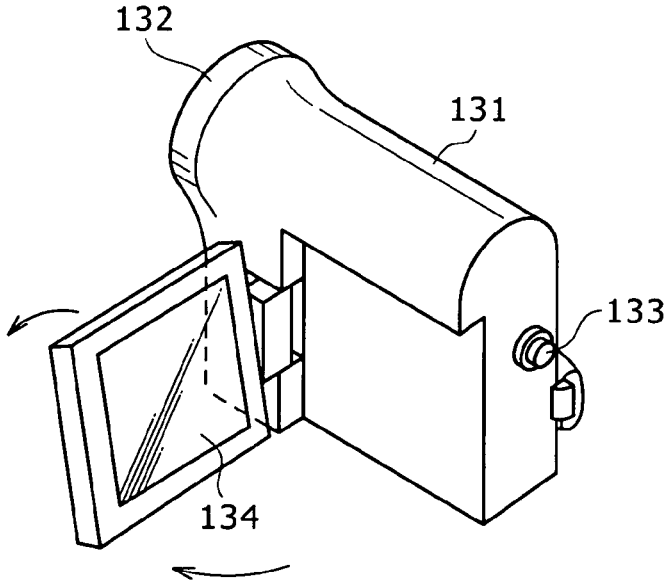
FIG. 18 is a perspective view showing a video camera to which the embodiment is applied.

FIG. 18 is a perspective view showing a video camera to which the embodiment is applied. This video camera includes a main body 131, a lens 132 that is disposed on the front side of the camera and used to capture a subject image, a start/stop switch 133 for the imaging operation, a display part 134, and so on. The video camera is fabricated by using the display according to the embodiment as the display part 134.

Figure 19F:
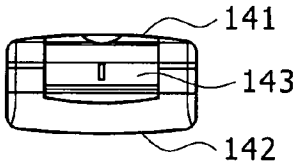
FIGS. 19A to 19G are perspective views showing a cellular phone to which the embodiment is applied.
Figure 19C:
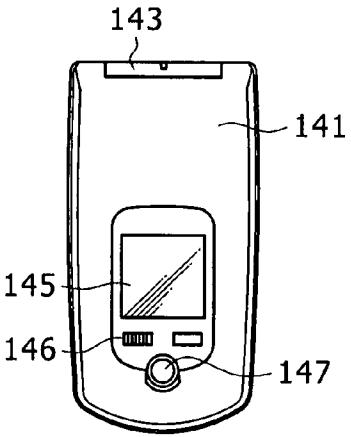
Figure 19E:
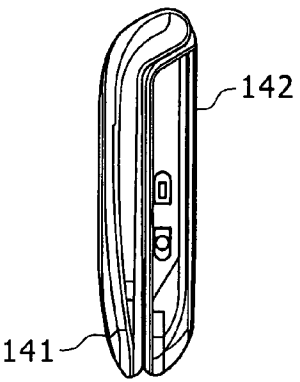
Figure 19G:
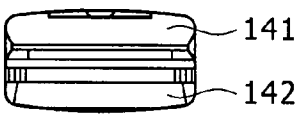
Figure 19D:
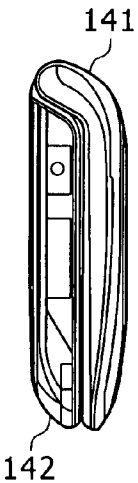
Figure 19B:
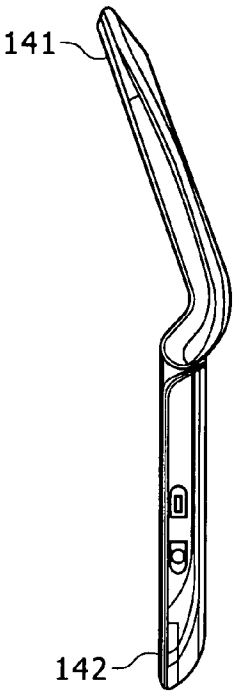
Figure 19A:
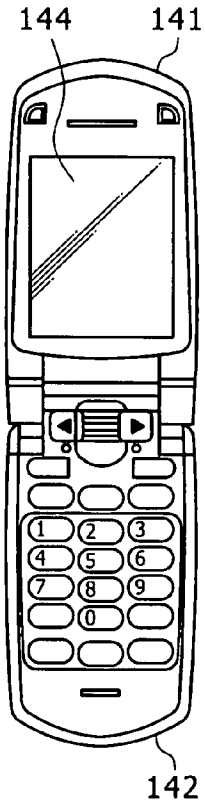

FIGS. 19A to 19G are perspective views showing a cellular phone as an example of portable terminal apparatus to which the embodiment is applied, FIGS. 19A and 19B are a front view and side view, respectively, of the opened state; and FIGS. 19C to 19G are a front view, left-side view, right-side view, top view, and bottom view, respectively, of the closed state. This cellular phone includes an upper casing 141, a lower casing 142, a connection (hinge) 143, a display 144, a subdisplay 145, a picture light 146, a camera 147, and so on. The cellular phone is fabricated by using the display according to the embodiment as the display 144 and the subdisplay 145.

It should be understood by those skilled in the art that various modifications, combinations, subcombinations and alterations may occur depending on design requirements and other factors in so far as they are within the scope of the appended claims or the equivalents thereof.

What is claimed is:

1. A display comprising:

a pixel array part configured to include pixels arranged in a matrix, each of the pixels including an electro-optical element, a write transistor for writing an input signal voltage supplied through a signal line, a holding capacitor for holding the input signal voltage written by the write transistor, and a drive transistor for driving the electro-optical element based on the input signal voltage held in the holding capacitor, the drive transistor being connected to a power supply line; and a drive circuit configured to selectively scan the pixels in the pixel array part on a row-by-row basis and perform a threshold correction operation against variation in a threshold voltage of at least one drive transistor for each selected row within a cycle of one horizontal scanning period, such that the threshold correction operation for a correction-target pixel row is performed in a given horizontal scanning period, wherein the drive circuit is further configured to perform a plurality of threshold correction preparation operations corresponding to the threshold correction operation while the write transistor is in a conductive state and a reference voltage being lower than the input signal voltage is supplied to the signal line, and before the threshold correction operation for the correction-target pixel row, over a plurality of previous horizontal scanning periods occurring before the given horizontal scanning period; and wherein the power supply line is configured to supply a low potential during the plurality of threshold correction preparation operations and a high potential during the threshold correction operation.

2. The display according to claim 1, wherein the drive circuit is further configured to perform mobility correction operation against variation in mobility of the drive transistor after the operation of the threshold correction during the given horizontal scanning period.

3. The display according to claim 2, wherein the drive circuit is further configured to perform mobility correction operation in a period for writing of the input signal voltage by the write transistor.

4. A method for driving a display that includes a pixel array part including pixels arranged in a matrix, each of the pixels including an electro-optical element, a write transistor for sampling and writing an input signal voltage supplied through a signal line, a holding capacitor for holding the input signal voltage written by the write transistor, and a drive transistor for driving the electro-optical element based on the input signal voltage held in the holding capacitor, the drive transistor being connected to a power supply line, the display including a drive circuit that selectively scans the pixels in the pixel array part on a row-by-row basis and performs a threshold correction operation against variation in a threshold voltage of at least one drive transistor for each selected row within a cycle of one horizontal scanning period, such that the threshold correction operation for a correction-target pixel row is performed in a given horizontal scanning period, the method comprising:

performing a plurality of threshold correction preparation operations corresponding to the threshold correction operation while the write transistor is in a conductive state and a reference voltage being lower than the input signal voltage is supplied to the signal line, and before the threshold correction operation for the correction-target pixel row, over a plurality of previous horizontal scanning periods occurring before the given horizontal scanning period, and supplying, by the power supply line, a low potential during the plurality of threshold correction preparation operations and a high potential during the threshold correction operation.

5. An electronic apparatus including a display, the display comprising:

a pixel array part configured to include pixels arranged in a matrix, each of the pixels including an electro-optical element, a write transistor for sampling and writing an input signal voltage supplied through a signal line, a holding capacitor for holding the input signal voltage written by the write transistor, and a drive transistor for driving the electro-optical element based on the input signal voltage held in the holding capacitor, the drive transistor being connected to a power supply line; and a drive circuit configured to selectively scan the pixels in the pixel array part on a row-by-row basis and perform a threshold correction operation against variation in a threshold voltage of at least one drive transistor for each selected row within a cycle of one horizontal scanning period, such that the threshold correction operation for a correction-target pixel row is performed in a given horizontal scanning period, wherein the drive circuit is further configured to perform a plurality of threshold correction preparation operations corresponding to the threshold correction operation while the write transistor is in a conductive state and a reference voltage being lower than the input signal voltage is supplied to the signal line, and before the threshold correction operation for the correction-target pixel row, over a plurality of previous horizontal scanning periods occurring before the given horizontal scanning period; and wherein the power supply line is configured to supply a low potential during the plurality of threshold correction preparation operations and a high potential during the threshold correction operation.

6. The method for driving the display according to claim 4, further comprising:

performing an operation of mobility correction against variation in mobility of the drive transistor after carrying out the operation of the threshold correction in the one horizontal scanning period of the correction-target pixel row.

7. The method for driving the display according to claim 6, further comprising:

carrying out the operation of the mobility correction in a period for writing of the input signal voltage by the write transistor.

8. The electronic apparatus according to claim 5, wherein the drive circuit carries out operation of mobility correction against variation in mobility of the drive transistor after the operation of the threshold correction in the one horizontal scanning period of the correction-target pixel row.

9. The electronic apparatus according to claim 8, wherein the drive circuit carries out the operation of the mobility correction in a period for writing of the input signal voltage by the write transistor.

* * * * *